US008166886B2

(12) United States Patent
Thum

(10) Patent No.: US 8,166,886 B2
(45) Date of Patent: May 1, 2012

(54) WEAR MONITORING SYSTEM, CABLE OPERATED TRANSPORTATION SYSTEM AND A METHOD FOR MONITORING WEAR-PRONE PARTS THEREIN

(75) Inventor: Richard Thum, Kornwestheim (DE)

(73) Assignee: HIMA Paul Hildebrandt GmbH + Co KG, Bruehl (DE)

( * ) Notice: Subject to any disclaimer, the term of this patent is extended or adjusted under 35 U.S.C. 154(b) by 0 days.

(21) Appl. No.: 12/807,747

(22) Filed: Sep. 13, 2010

(65) Prior Publication Data

US 2011/0073000 A1 Mar. 31, 2011

Related U.S. Application Data

(63) Continuation of application No. PCT/EP2009/052956, filed on Mar. 13, 2009.

(30) Foreign Application Priority Data

Mar. 13, 2008 (DE) ..... 10 2008 015 035

(51) Int. Cl.
*B61B 12/06* (2006.01)

(52) U.S. Cl. ..... 104/197; 104/112; 104/179; 104/173.1

(58) Field of Classification Search ..... 104/112, 104/117, 117.1, 173.1, 173.2, 178, 179, 180, 104/197; 340/686.1, 686.2, 686.3, 3.43, 340/3.44, 505–57, 517, 540; 324/207.11–207.2; 702/150, 145, 147; 212/167, 316, 276; 200/61.15–61.18

See application file for complete search history.

(56) References Cited

U.S. PATENT DOCUMENTS

| | | | |
|---|---|---|---|
| 4,003,314 | A | 1/1977 | Pearson |
| 4,019,002 | A | 4/1977 | Kunczynski |
| 4,088,988 | A | 5/1978 | Berger |
| 4,341,257 | A | 7/1982 | Scheurecker et al. |
| 4,363,945 | A | 12/1982 | Kunczynski |

(Continued)

FOREIGN PATENT DOCUMENTS

| | | |
|---|---|---|
| DE | 197 52 362 | 6/1999 |

(Continued)

*Primary Examiner* — S. Joseph Morano
*Assistant Examiner* — Zachary Kuhfuss
(74) *Attorney, Agent, or Firm* — Lipsitz & McAllister, LLC

(57) ABSTRACT

A wear monitoring system is provided for monitoring the wear and/or abrasion of at least one system component of a cable operated transportation system, where the system component is subjected to wear and/or abrasion and is mounted in rotating and/or circulating manner. A parameter measuring device is provided for measuring an actual value and/or a time-dependent actual value function of at least one electrical and/or mechanical parameter of the at least one system component and/or the drive unit. An evaluating device is provided for determining a parameter deviation of the actual value from a desired value in dependence on time or a time interval and/or of the actual value function from a time-dependent desired value function of the at least one parameter. The parameter deviation corresponds to the state of abrasion and/or the state of wear of the at least one system component.

21 Claims, 12 Drawing Sheets

U.S. PATENT DOCUMENTS

Figure 1:
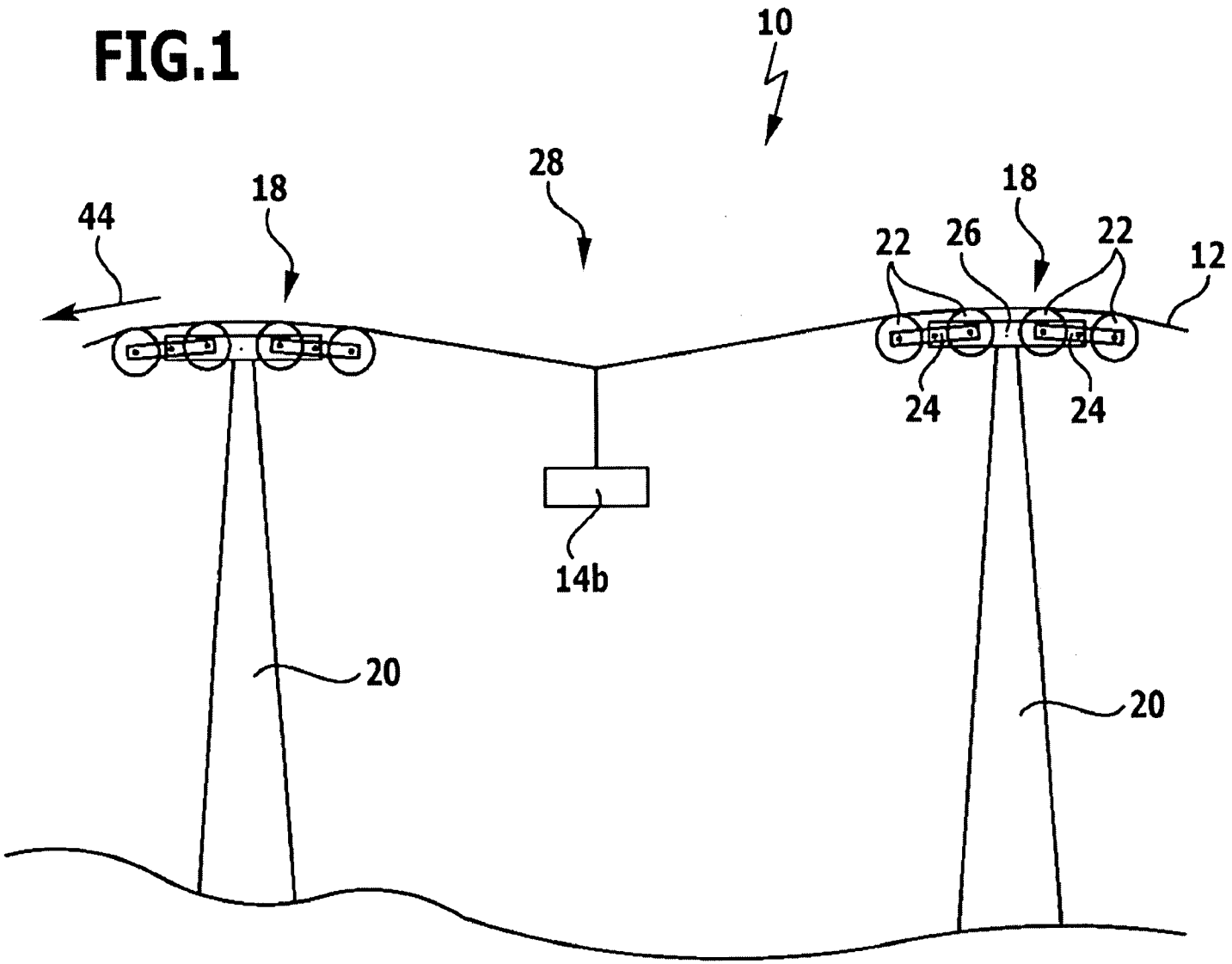

| | | | |
|---|---|---|---|
| 4,671,187 | A | 6/1987 | Kunczynski |
| 5,201,272 | A | 4/1993 | Simon |
| 5,528,219 | A | 6/1996 | Frohlich et al. |
| 5,581,180 | A | 12/1996 | Ito et al. |
| 5,721,533 | A | 2/1998 | Smith |
| 5,959,272 | A | 9/1999 | Marchitto |
| 5,977,662 | A | 11/1999 | Lamarche et al. |
| 6,356,202 | B1 | 3/2002 | Albrich et al. |
| 7,432,703 | B2 | 10/2008 | Heimlicher et al. |
| 2008/0208519 | A1 | 8/2008 | Thum |

FOREIGN PATENT DOCUMENTS

| | | |
|---|---|---|
| DE | 196 20 065 | 11/1999 |
| DE | 10 2006 014 131 | 6/2007 |
| DE | 10 2006 036 251 | 2/2008 |
| DE | 10 2007 006 316 | 4/2008 |
| EP | 0 771 709 | 5/1997 |
| EP | 1 038 354 | 9/2000 |

44
12
42
32
50
68
22
54
74
Converter Unit
70 Evaluating Device
46
18
10
40
52
38
Signal Generating Device
82
80 Comparison Scale
72
Control/ Regulating Device
16
Evaluating Device
78
Memory
90
Drive Means
75
Averaging Unit
76
Reliability State Determining Device
Alarm Device
112
Abrasion Determining Device
86
114
Max Value Detecting Device
88
Alarm Signal Display Device
84
Indicator Device
92 Cable Position Detecting Device

WEAR MONITORING SYSTEM, CABLE OPERATED TRANSPORTATION SYSTEM AND A METHOD FOR MONITORING WEAR-PRONE PARTS THEREIN

CROSS-REFERENCE TO RELATED APPLICATIONS

This application is a continuation under 35 U.S.C. §365 of international application number PCT/EP2009/052956, filed on Mar. 13, 2009, which claims priority to German application 10 2008 015 035.5, filed Mar. 13, 2008. The contents of both applications are incorporated by reference herein in their entirety and for all purposes.

FIELD OF THE INVENTION

The present invention relates to wear monitoring systems for monitoring the wear and/or the abrasion of at least one system component of a cable operated transportation system generally, and more specifically to a wear monitoring system for monitoring the wear and/or the abrasion of at least one system component of a cable operated transportation system comprising a support cable and/or a traction cable and/or a hoisting cable and also at least one drive unit, wherein said system component is subjected to wear and/or abrasion and is mounted in rotating and/or circulating manner.

Moreover, the present invention relates to cable operated transportation systems generally, and more specifically to a cable operated transportation system consisting of at least one cable, at least one drive unit for moving the at least one cable and at least one system component which is mounted in rotating and/or circulating manner and is used for driving and/or guiding the at least one cable or other components of the transportation system.

Finally, the present invention also relates to methods for monitoring the wear and/or the abrasion of at least one system component of a cable operated transportation system generally, and more specifically to a method for monitoring the wear and/or the abrasion of at least one system component of a cable operated transportation system comprising a support cable and/or a traction cable and/or a hoisting cable and also at least one drive unit, wherein said system component is subjected to wear and/or abrasion and is mounted in rotating and/or circulating manner.

BACKGROUND OF THE INVENTION

In cable operated transportation systems such as aerial ropeways in the form of chair lifts or gondola cars, the support-, traction- and/or hoisting cables of the transportation system are guided over revolving and/or rotationally mounted system components such as cable pulleys or guide pulleys and also driving pulleys for example. The cable pulleys in particular are generally arranged on support masts in the open countryside, wherein a plurality of cable pulleys together can form a pulley assembly. It is not just the cable pulleys that are subject to wear and abrasion, but also all the moving components in the system which cooperate directly or indirectly with the at least one cable such as transportation devices for accommodating people and/or goods which are fixed permanently or temporarily to the cable such as chairs or gondolas and in particular gondola cabins for example. Wear can occur especially in the form of binding up to the complete seizure of the bearings of the revolving and/or rotationally mounted system components. Wear and/or abrasion can also arise in particular in the air-filled friction wheels which are utilised in order to accelerate the transportation devices, such as the gondola cars of a cable-car system and the chairs of a chair lift system that are only temporarily fixed to the cable, up to the speed of the cable or for braking them for the purposes of loading them or for permitting people to climb in or out of them. Thus, in the case of air-filled friction wheels for example, a loss of pressure can reduce or prevent the traction thereof. Moreover, system components which are mounted in a rotating and/or circulating manner in the form of transmission belts, for example drive belts for driving pulleys or friction wheels, can be subjected to wear or abrasion. This manifests itself by slippage or overstretching thereof, whereby, the traction of friction wheels which are driven by the transmission belts can likewise be reduced or prevented.

The unwanted consequence of the practically unavoidable wear and/or abrasion is that, in dependence on the type and extent of the wear or the abrasion, the operational reliability of the cable operated transportation system cannot be ensured over a long period of time.

Therefore, it would be desirable to provide a method and a device or a system with the aid of which the operational reliability of a cable operated transportation system can be increased, and thus a transportation system could be improved accordingly.

SUMMARY OF THE INVENTION

In a first aspect of the invention, a wear monitoring system for monitoring the wear and/or the abrasion of at least one system component of a cable operated transportation system comprises a support cable and/or a traction cable and/or a hoisting cable and also at least one drive unit wherein said system component is subjected to wear and/or abrasion and is mounted in rotating and/or circulating manner. The system further includes a parameter measuring device for measuring an actual value and/or a time-dependent actual value function of at least one electrical and/or mechanical parameter of the at least one system component and/or the drive unit. The system also includes an evaluating device for determining a parameter deviation of the actual value from a desired value in dependence on time or a time interval and/or of the actual value function from a time-dependent desired value function of the at least one parameter, which parameter deviation corresponds to the state of abrasion and/or the state of wear of the at least one system component.

In a second aspect of the invention, a cable operated transportation system comprises a cable, at least one drive unit for moving the cable and at least one system component which is mounted in rotating and/or circulating manner for driving and/or guiding the cable or other components of the transportation system. The system further comprises a wear monitoring system for monitoring the wear and/or the abrasion of the at least one system component which is subjected to wear and/or abrasion and is mounted in rotating and/or circulating manner. The wear monitoring system comprises a parameter measuring device for measuring an actual value and/or a time-dependent actual value function of at least one electrical and/or mechanical parameter of the at least one system component and/or the drive unit and also comprises an evaluating device for determining a parameter deviation of the actual value from a desired value in dependence on time or a time interval and/or a deviation of the actual value function from a time-dependent desired value function of the at least one parameter, which parameter deviation corresponds to the state of abrasion and/or the state of wear of the at least one system component.

In a third aspect of the invention, a method is provided for monitoring the wear and/or the abrasion of at least one system component which is subjected to wear and/or abrasion and is mounted in rotating and/or circulating manner and forms part of a cable operated transportation system comprising a support cable and/or a traction cable and/or a hoisting cable and also at least one drive unit. An actual value and/or a time-dependent actual value function of at least one electrical and/or mechanical parameter of the at least one system component and/or the drive unit is measured. A parameter deviation of the actual value from a desired value is determined in dependence on time or a time interval and/or a deviation of the actual value function from a time-dependent desired value function of the at least one parameter, which parameter deviation corresponds to the state of abrasion and/or the state of wear of the at least one system component.

BRIEF DESCRIPTION OF THE DRAWING FIGURES

Figure 2:
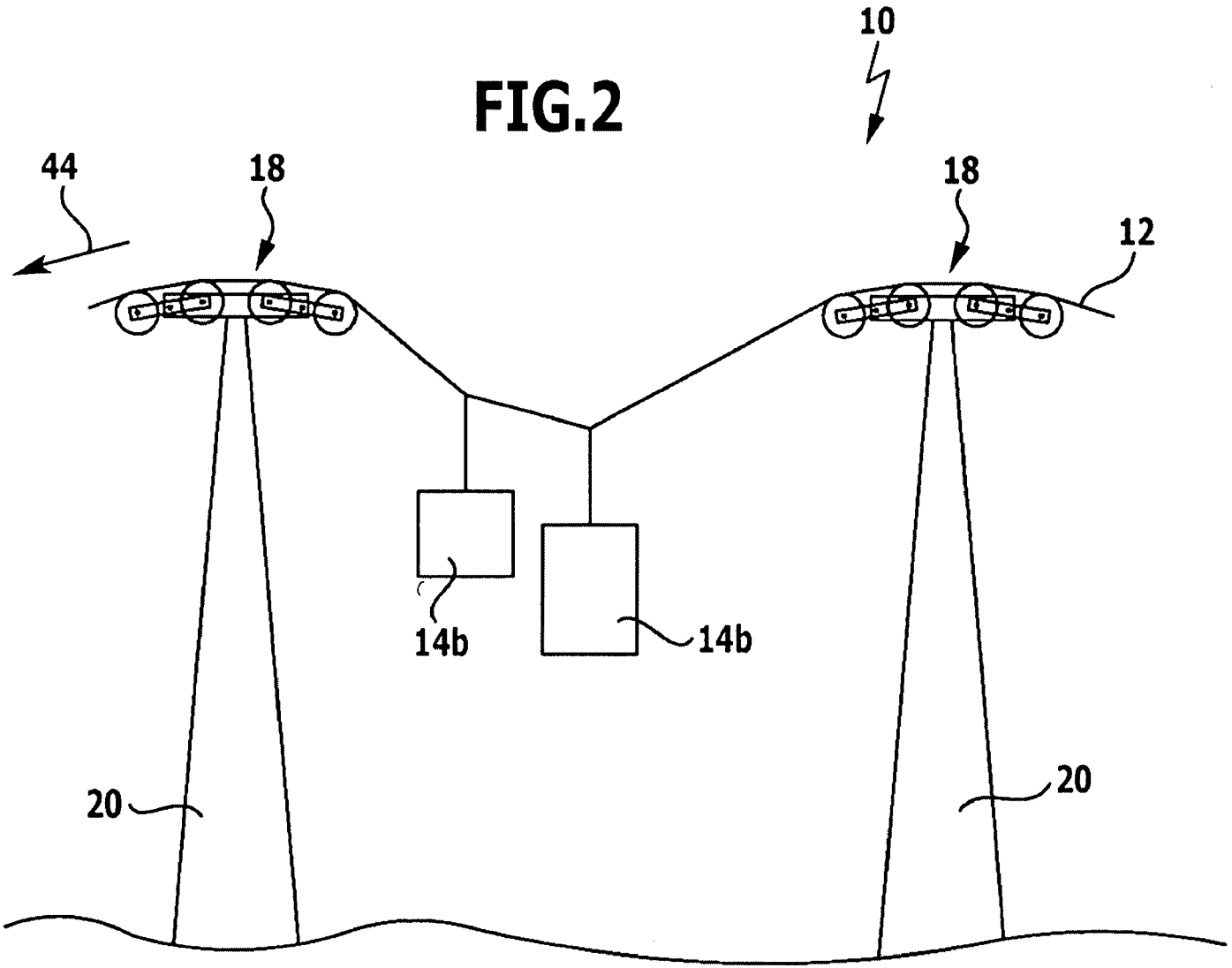
Figure 3:
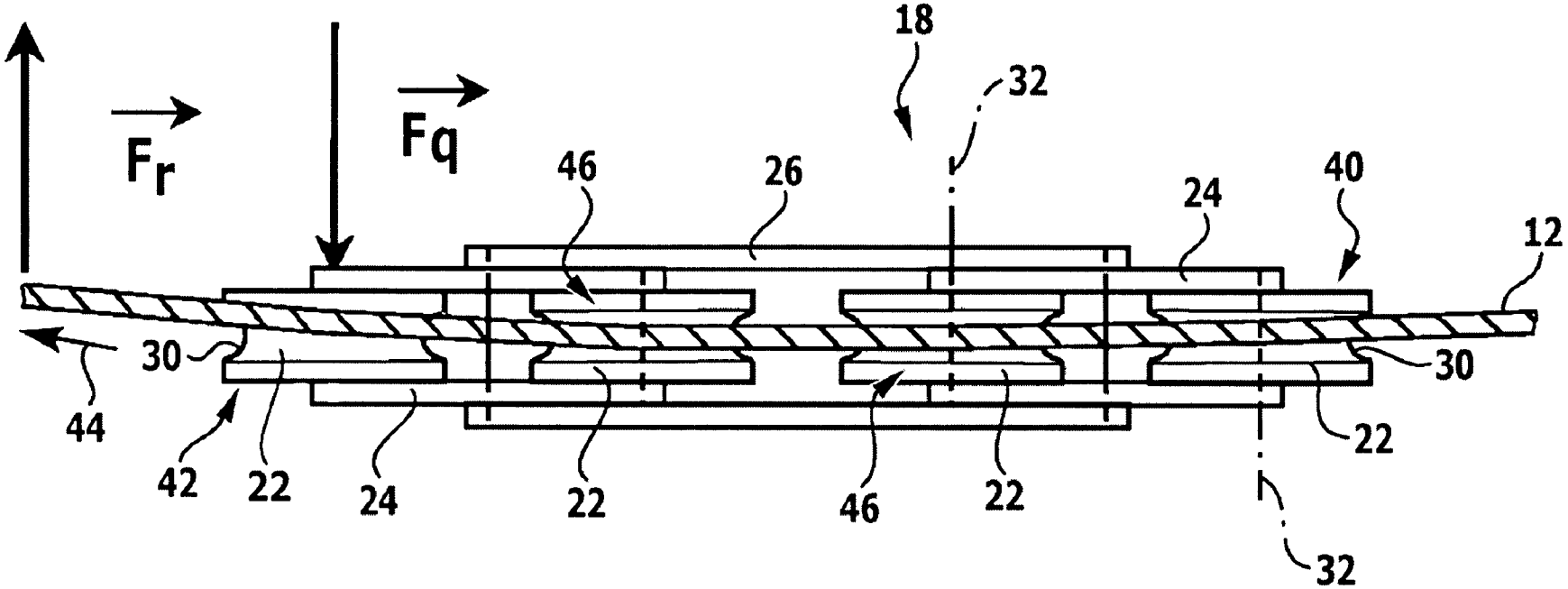
Figure 4:
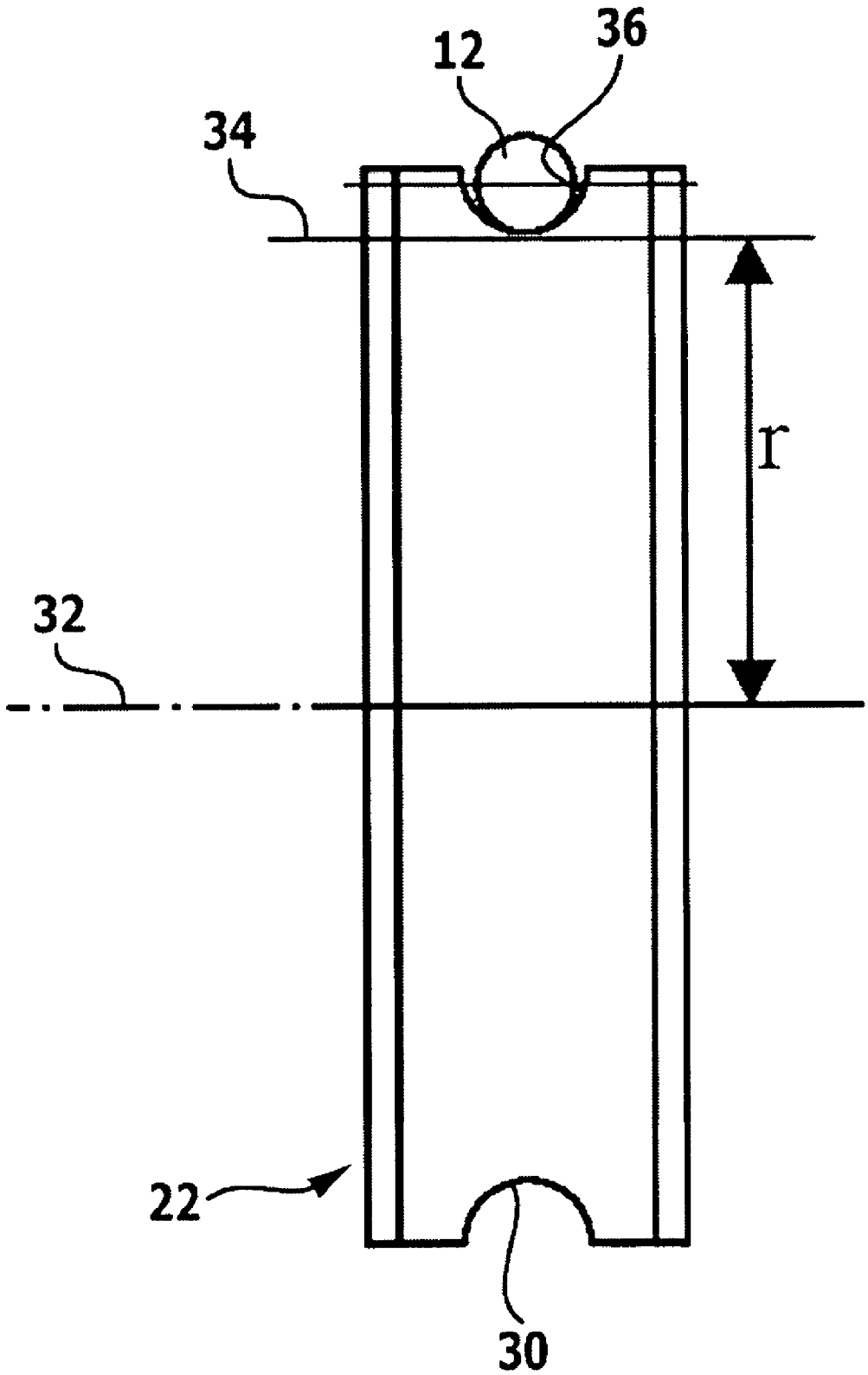
Figure 5:
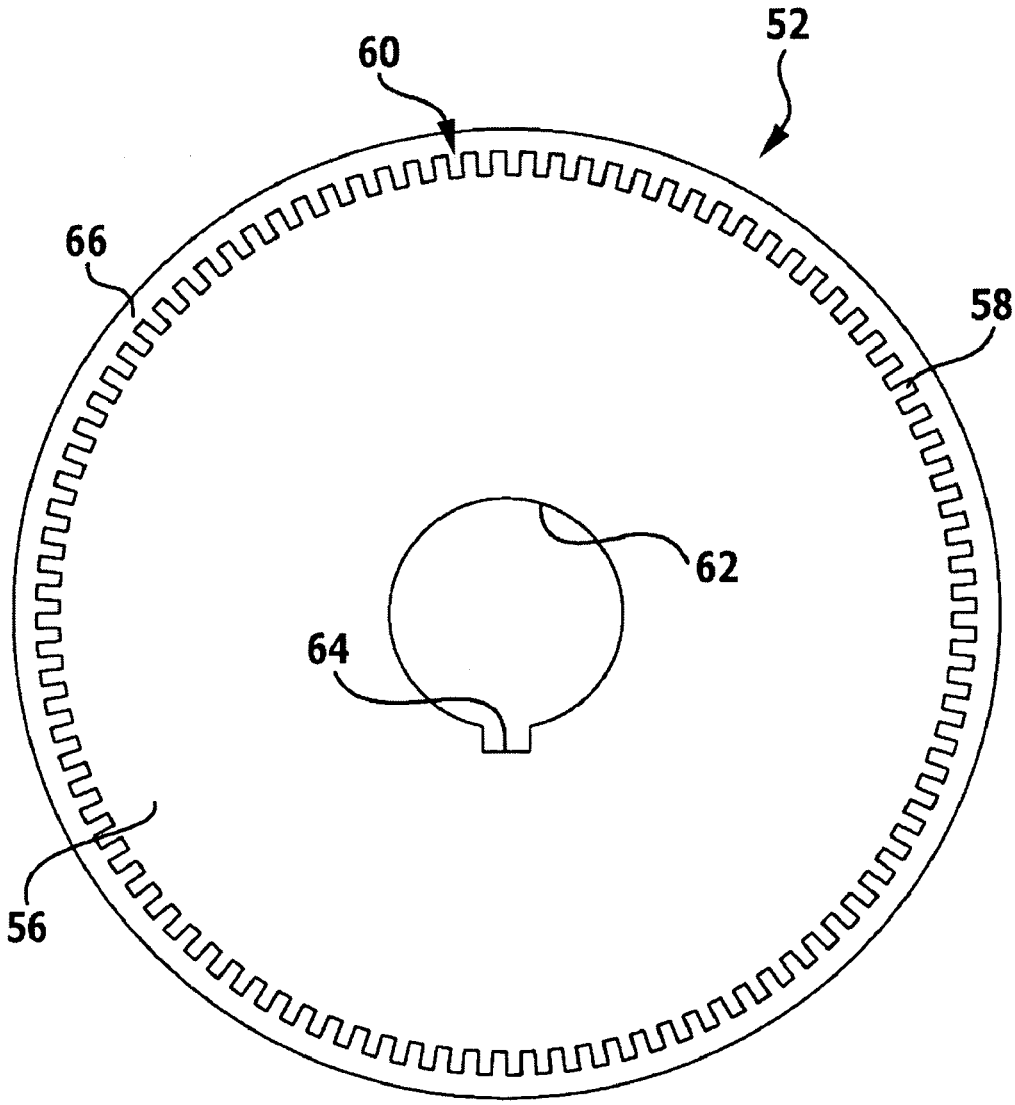
Figure 6:
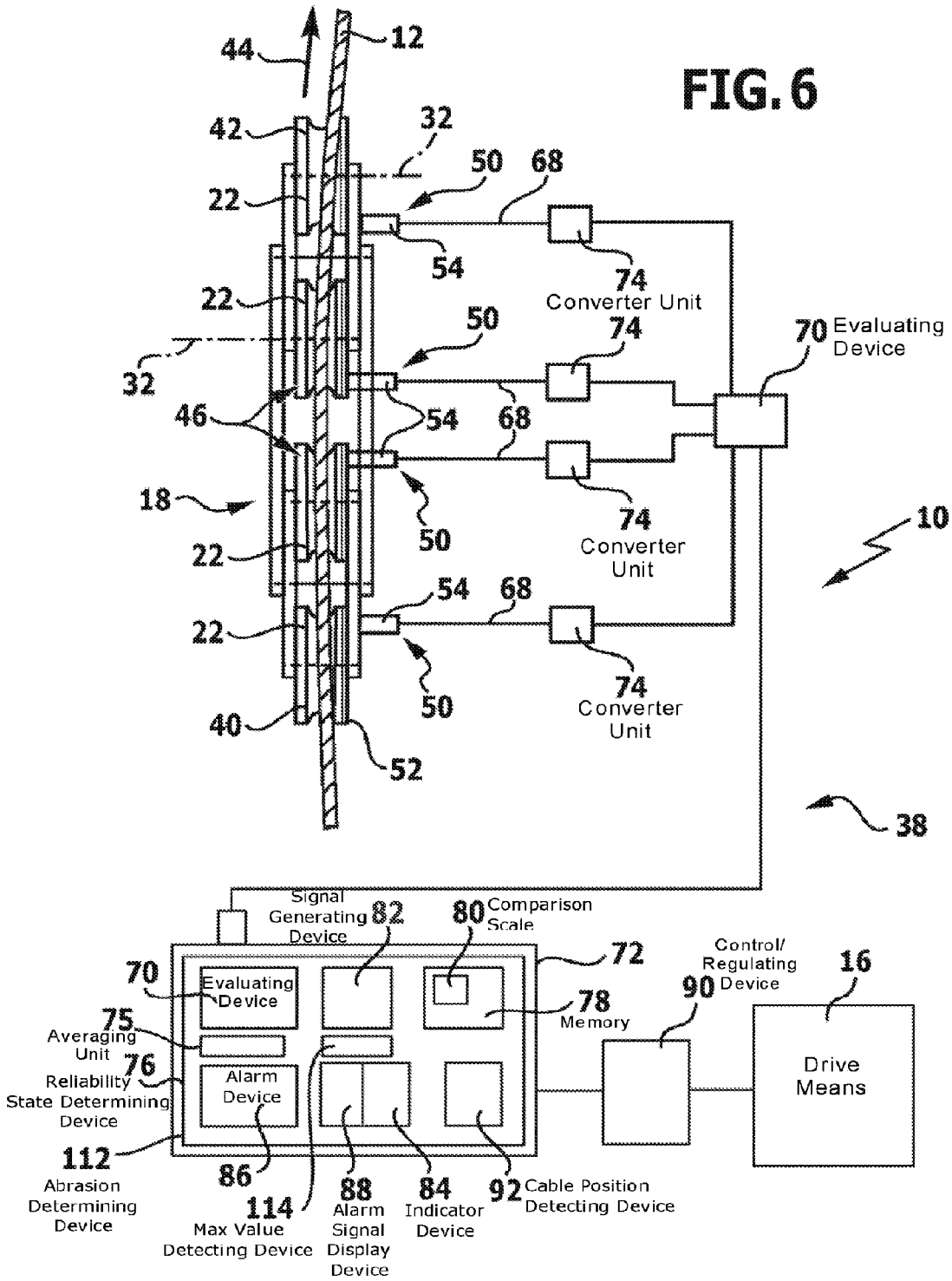
Figure 7:
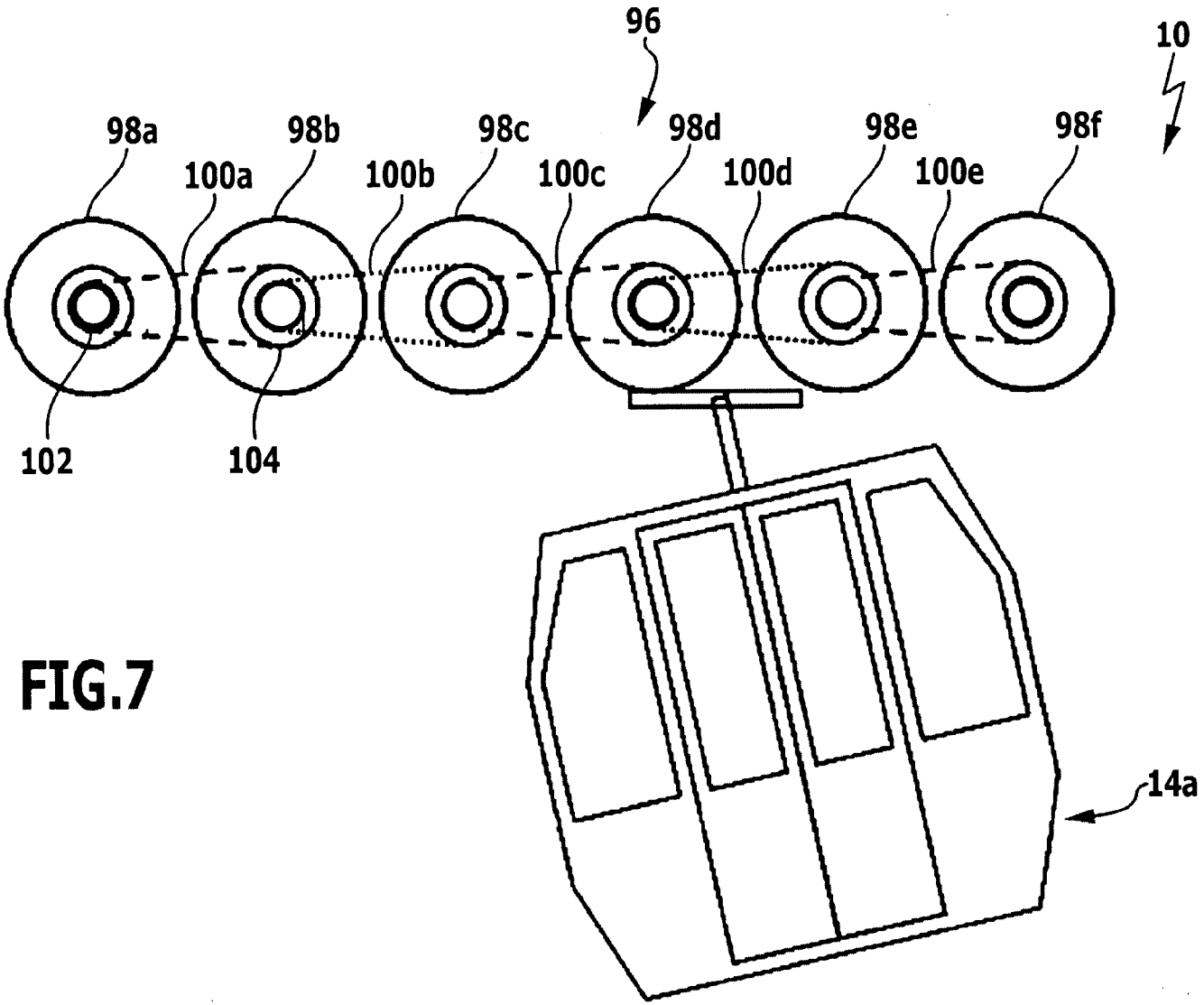
Figure 8:
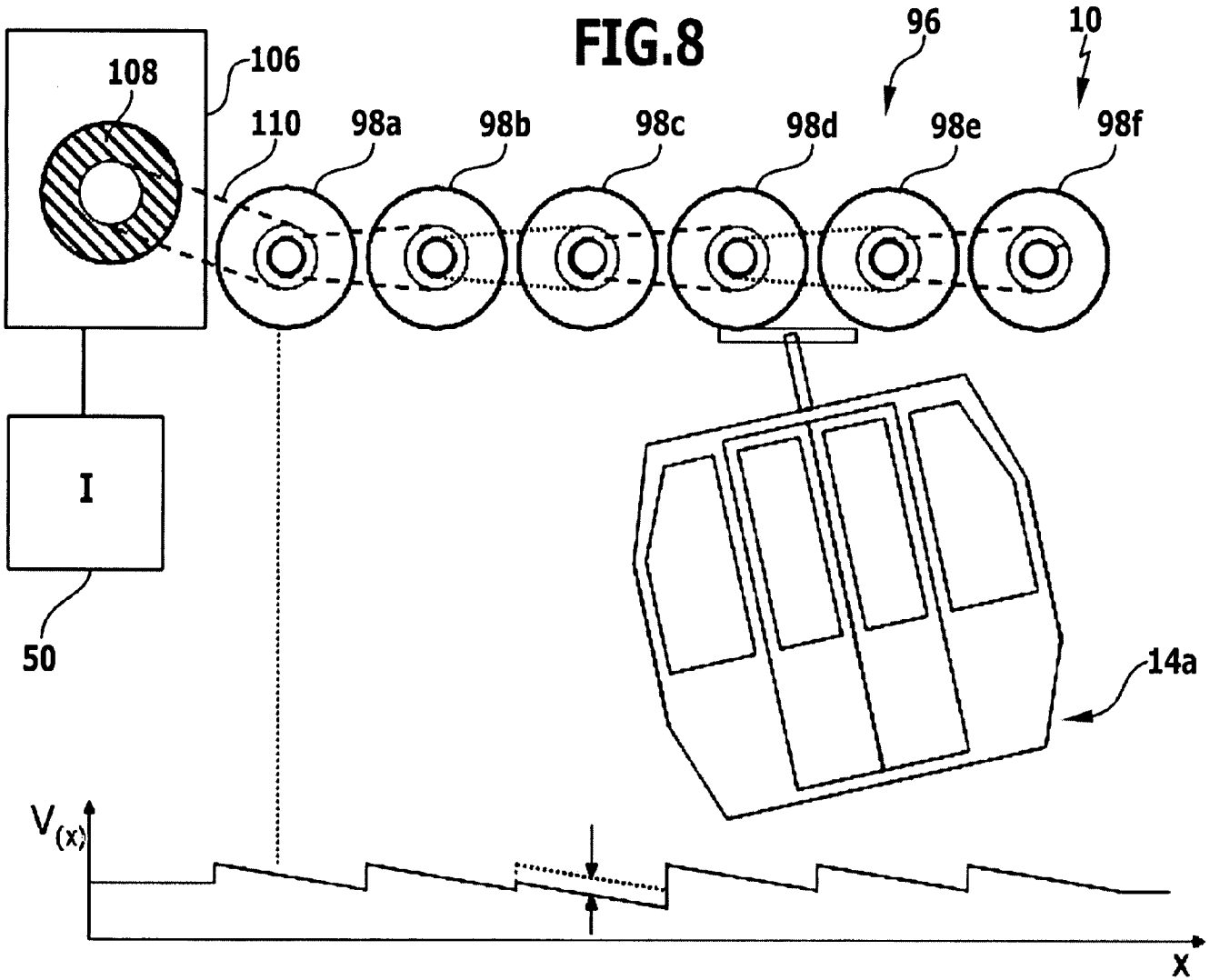
Figure 9:
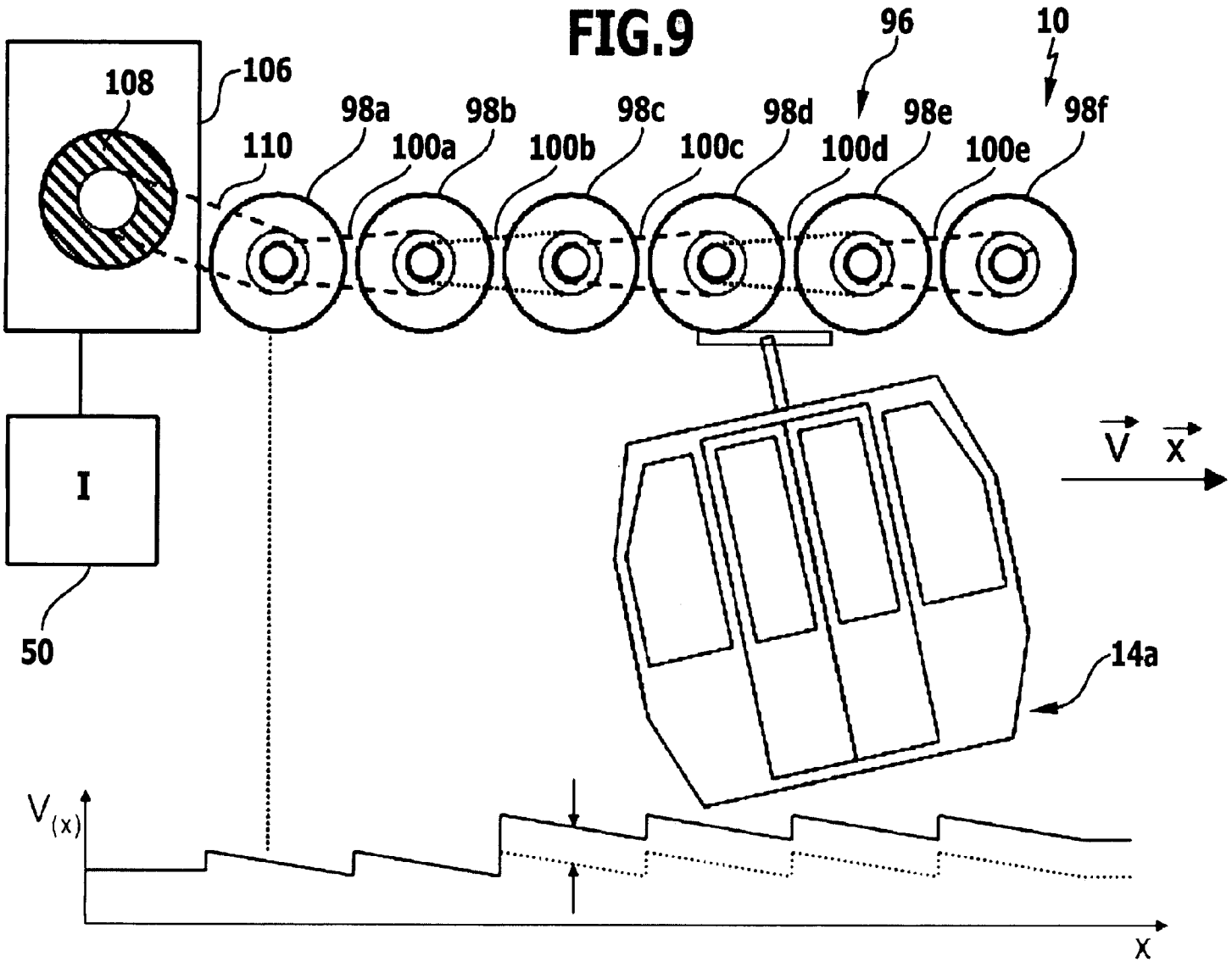
Figure 10:
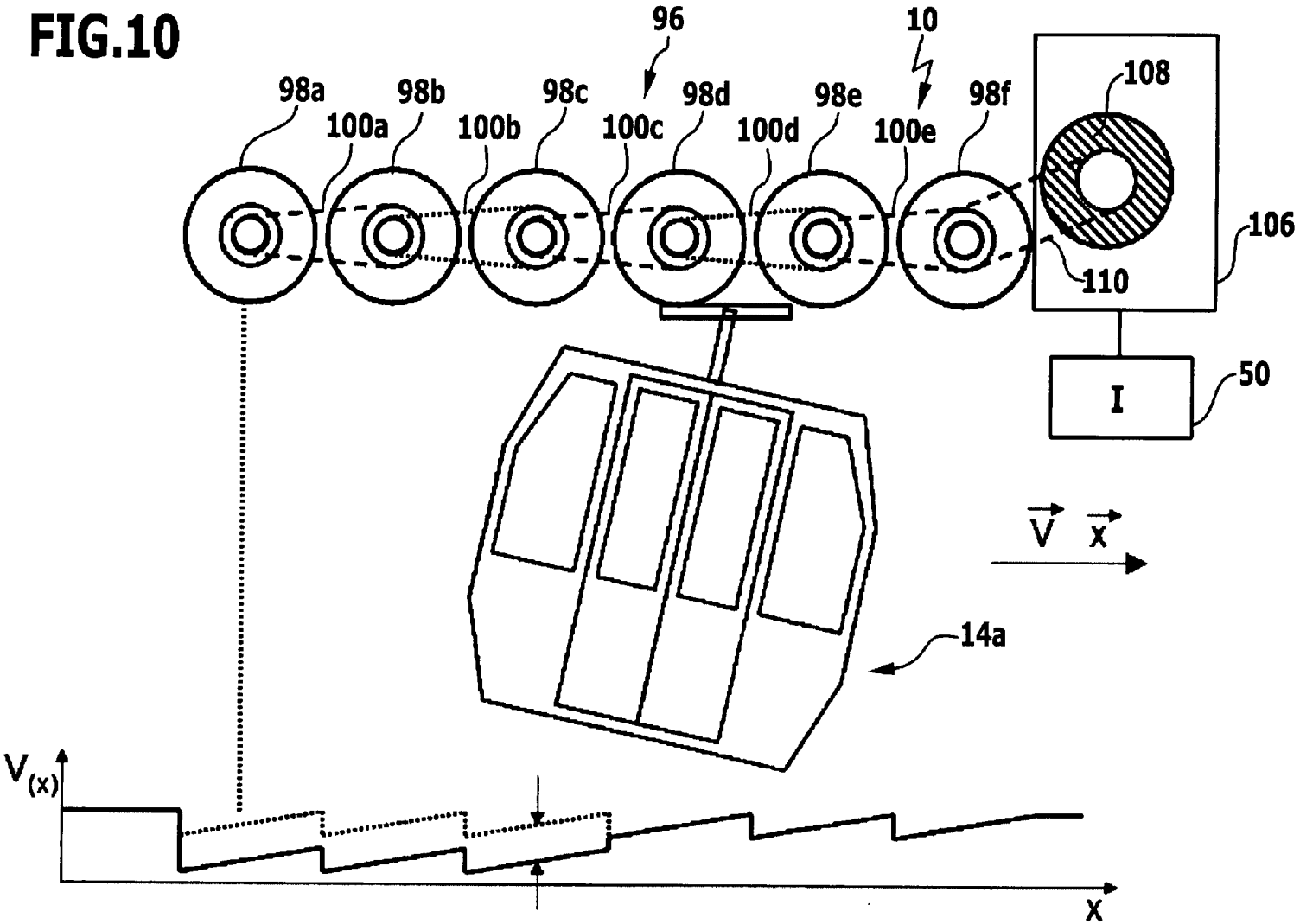
Figure 11:
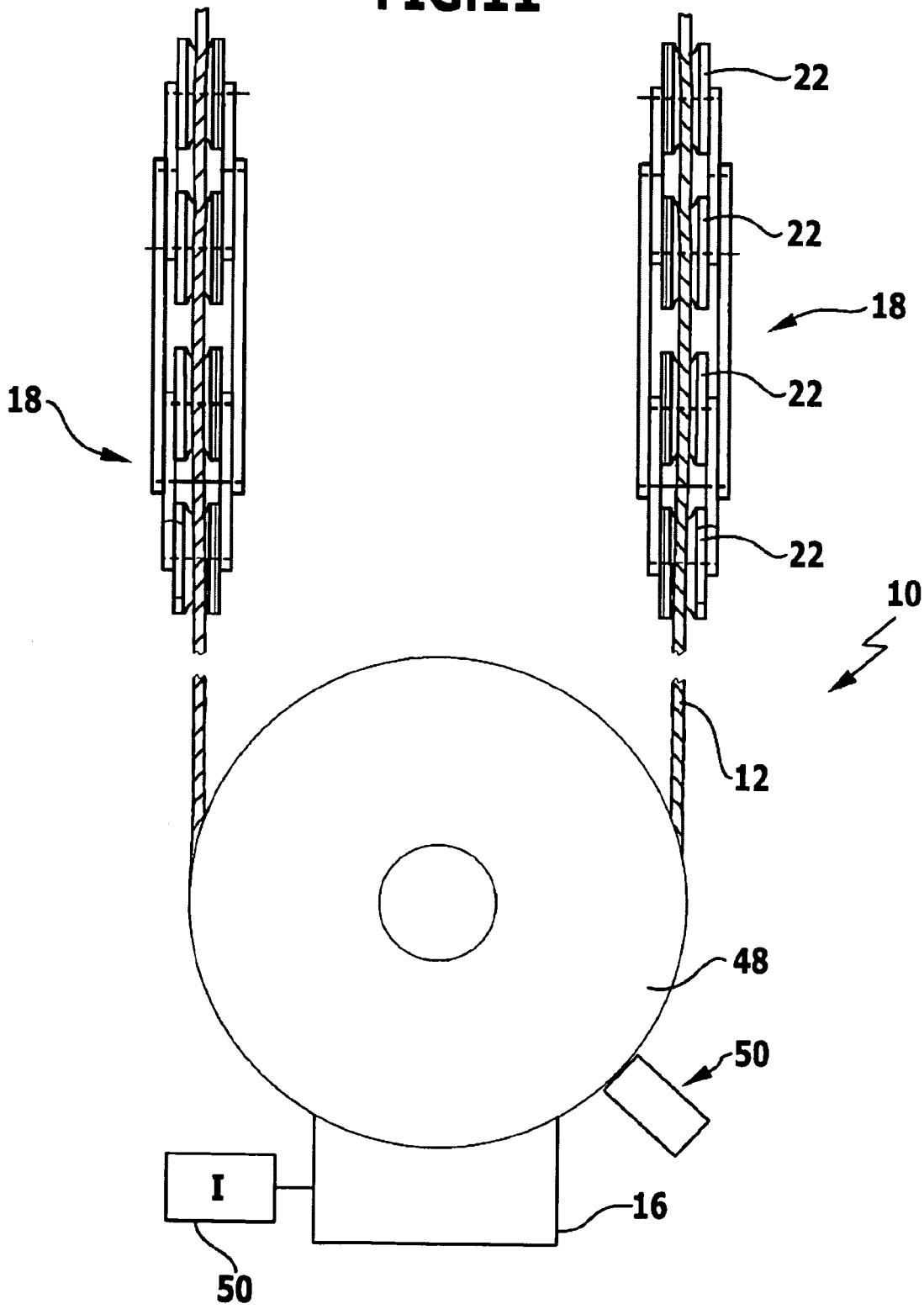

The foregoing summary and the following description may be better understood in conjunction with the drawing figures, of which:

FIG. 1: shows a schematic illustration of two support masts and the pulley assemblies of an aerial ropeway under a light load;

FIG. 2: a schematic illustration of two support masts and the pulley assemblies of an aerial ropeway under a heavier load;

FIG. 3: a plan view of a pulley assembly wherein transverse forces are effective on the cable;

FIG. 4: a sectional view through a cable pulley over which a cable is being guided without any effective transverse forces;

FIG. 5: a sectional view of a timing disc;

FIG. 6: a schematic illustration of a wear monitoring system of a cable operated transportation system;

FIG. 7: a schematic illustration of a friction wheel assembly of the transportation system for decelerating/accelerating a gondola car, FIG. 8: a schematic illustration of a decelerating friction wheel assembly with a damaged friction wheel;

FIG. 9: a schematic illustration of a decelerating friction wheel assembly wherein a transmission belt is overstretched;

FIG. 10: a schematic illustration of a friction wheel assembly forming part of an acceleration stretch wherein a transmission belt is overstretched, dirty or covered with dew;

FIG. 11: a schematic illustration of a part of a transportation system; and

Figure 12:
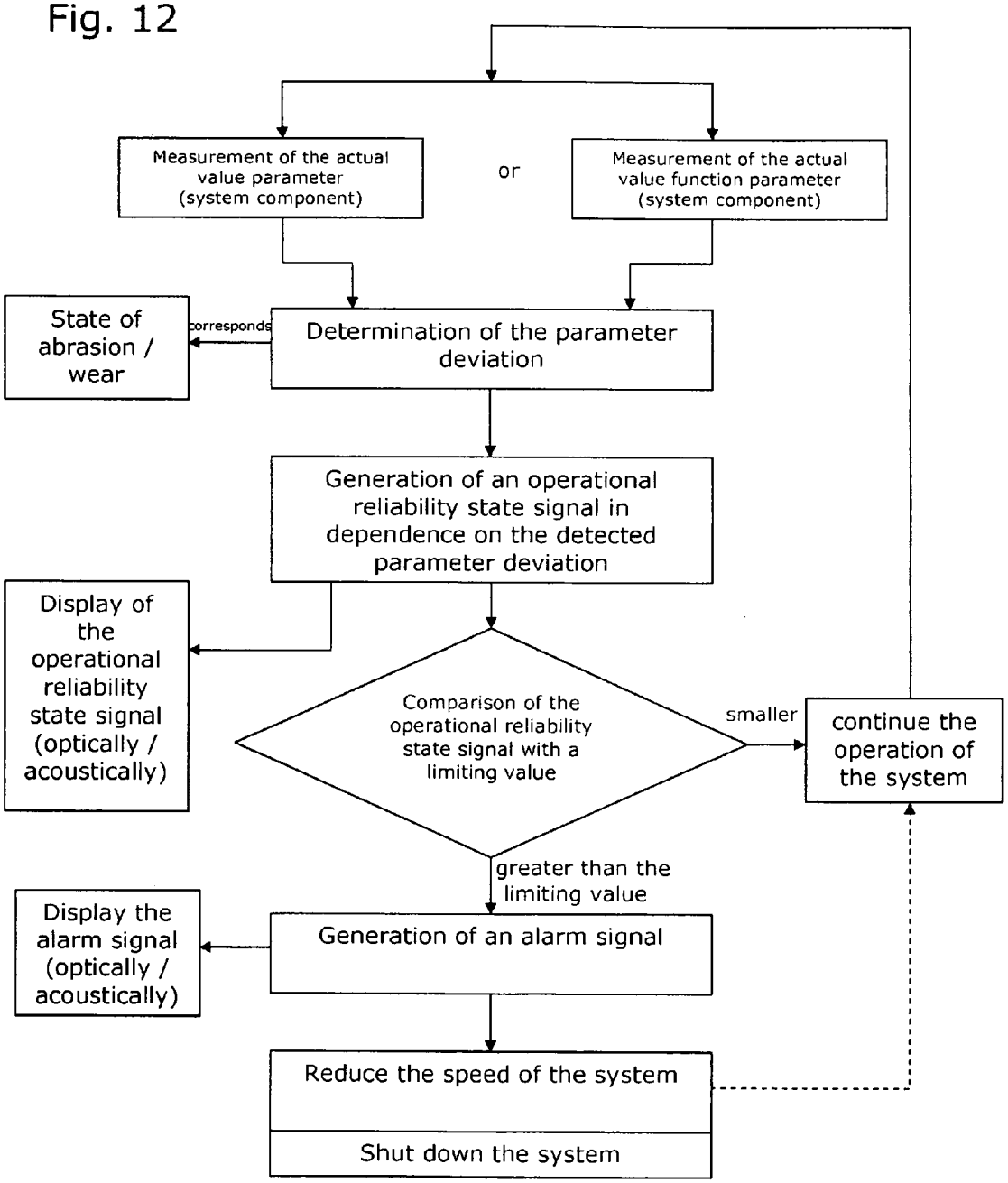

FIG. 12: a flow chart for a method of monitoring wear in the system components of a cable operated transportation system.

DETAILED DESCRIPTION OF PREFERRED EMBODIMENTS OF THE INVENTION

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a wear monitoring system for monitoring the wear and/or the abrasion of at least one system component of a cable operated transportation system comprising a support cable and/or a traction cable and/or a hoisting cable and also at least one drive unit wherein said system component is subjected to wear and/or abrasion and is mounted in rotating and/or circulating manner, including a parameter measuring device for measuring an actual value and/or a time-dependent actual value function of at least one electrical and/or mechanical parameter of the at least one system component and/or the drive unit and also including an evaluating device for determining a parameter deviation of the actual value from a desired value in dependence on time or a time interval and/or of the actual value function from a time-dependent desired value function of the at least one parameter, which parameter deviation corresponds to the state of abrasion and/or the state of wear of the at least one system component.

In principle, it is possible to establish in a simple manner how severely the functioning of each system component that is mounted in rotating and/or circulating manner is being impaired by abrasion and/or wear particularly over the course of time with the aid of such a wear monitoring system. If an actual value for the parameter is determined, then this actual value can be detected in time-dependent manner, whereby its deviation from a desired value in dependence on time will become larger and larger, the greater the abrasion and/or the wear of the system component. Furthermore, the size and form of the parameter deviation of the actual value in dependence on time, or, of the actual value function relative to the time-dependent desired value function enables the type of wear and abrasion to be determined. For example, in the case where the rotation of a cable pulley is being monitored, damage to the pulley bearing will lead to a decrease in the rotational speed until it finally stops and thus to a large, above average, deviation of the parameter. Unbalances of a system component being monitored can be ascertained from oscillatory deviations of the parameter in the course of time correlated to the rotation cycles for example. The proposed wear monitoring system is of very simple construction, because it only requires the monitoring of a mechanical parameter of the system component and/or of an electrical or mechanical parameter of the at least one drive unit for example. A change in the friction wheels or the transmission belts can be ascertained indirectly from the current waveform of the drive current for the at least one drive unit. Slippage of the belts leads to a reduced level of traction and thus to the need for less torque from the drive means with the consequence of a reduction in power consumption. The wear monitoring system is exceptionally well-suited to the task of retro-fitting pre-existing cable operated transportation facilities at low cost. The wear monitoring system results in an increase in the operational reliability of the cable operated transportation system since the detected deviation of a parameter can also be used, in particular, to have an effect upon the operation of the system such as to lower the operational speed or completely shut down the system in the event that the state of abrasion and/or the state of wear of at least one of the system components being monitored becomes so great that the operational reliability of the transportation system or parts thereof can no longer be ensured. Furthermore, the invention makes it possible for the parameter measuring devices such as proximity switches or other sensor devices to be mounted on cable masts where they can be protected from lightning strikes since the parameter measuring devices do not have to be arranged directly in the proximity of the cable, but can, in particular, be located underneath it such that they are spaced from the current path formed as a result of a lightning strike.

It is expedient, if the parameter measuring device comprises a movement magnitude device for measuring the actual value and/or the actual value function of at least one first movement magnitude of the at least one system component which defines a mechanical parameter. For example, the rotational speeds, the speeds, the angular speeds or the accelerations of the system component can be determined in a simple manner with the aid of the movement magnitude measuring device and the wear and/or abrasion can then be deduced from the time-dependent pattern thereof.

The construction of the wear monitoring system can be simplified in a simple manner if the movement magnitude measuring device is configured to measure the actual value and/or the actual value function of at least one second movement magnitude, which defines a mechanical parameter, of at least one reference component of the transportation system which is mounted in rotating and/or circulating manner. In particular, the actual value and/or the actual value function of the at least one second movement magnitude can be used respectively as a time-dependent desired value or as a desired value function. In other words, this means that actual values or actual value functions of the first movement magnitude of the at least one system component that is to be monitored can be compared respectively with those time-dependent actual values or the actual value function defining a desired value or a desired value function of the second movement magnitude of the reference component of the transportation system. For example, if the system component that is to be monitored can be a cable pulley, the reference component can be an identical cable pulley. If the hoisting cable or the traction cable of the transportation system is running over the cable pulley and the reference pulley at the same speed, then, under identical loadings, the ratio between the actual values or the actual value functions of the parameter that have been determined from the two components would have to develop in the same way over time. If, however, in the course of time, there are increasing deviations from one another, then one can immediately conclude that abrasion has occurred in or on one of the two components, for example, based on an increase in the rotational speed that has occurred in the course of time, one can conclude therefrom that there is abrasion of the cable pulley as a result of a decrease in the diameter thereof. Preferably, an additional system component which is also mounted in rotating and/or circulating manner can be used as a reference component, for example, a reference pulley which is driven by the cable although it is not necessary for the actual operation of the transportation system and runs separately therefrom. It is expedient for the reference component not to be affected by excessive cable forces so that it can be driven substantially unloaded and, insofar as possible, without appreciable slippage by the moving cable.

It is advantageous, if the evaluating device is configured to determine a parameter-deviation-defining movement magnitude deviation of the actual value and/or the actual value function of the at least one first movement magnitude and of the at least one second movement magnitude from one another. In consequence, the evaluating device is suitable for directly comparing the detected values of the first and second movement magnitude with one another and thus for determining the parameter deviation that is to be used for assigning the state of abrasion and/or the state of wear.

Preferably, the evaluating device is configured to determine a change of the parameter deviation in dependence on the period of operation or an operating interval of the transportation system, which change of the parameter deviation corresponds to the state of abrasion and/or the state of wear of the at least one system component in dependence on the period of operation or the operating interval. In other words, it is expedient if it is not just the parameter deviation itself that is determined, but also the time-dependent profile thereof. The greater the deviation of the parameter over the course of time, the more obvious it will be that there is increasing abrasion or increasing wear of the monitored system component.

The construction of the wear monitoring system is particularly simple and it can be equipped with commercially available parameter measuring devices, if the latter comprise a torque measuring device, a rotational speed and/or angular speed measuring device for measuring the mechanical parameter in the form of a torque, a rotational speed or an angular speed. Thus, for example, the abrasion of individual system components can be determined by comparing the rotational speed of two system components in time-dependent manner (e.g., using a system component that is to be monitored and a reference component). For example, the reference component can be a cable pulley which is arranged on a pulley assembly comprising several cable pulleys in such a way that a cable force and in particular a transverse force on the cable pulley that is exerted as a result of external side forces such as wind forces for example that are effective on the cable is minimal. Coming into question in particular here, are the inner cable pulleys of a pulley assembly where the abrasion is usually particularly low since they are shielded by the run-in and run-out pulleys and possibly also by further neighbouring pulleys. For the purposes of monitoring the operational reliability state, it is advantageous for the run-in and run-out pulleys of a plurality of pulley assemblies that comprise cable pulleys to be monitored, since transverse forces on these cable pulleys arising especially due to wind, cause an over-proportionately large amount of abrasion. In other words, this means that the run-in and run-out pulleys are abraded to the greatest extent so that it makes sense to determine the state of abrasion and/or the state of wear of these pulleys and then assess the operational reliability state of the transportation system in dependence on the detected state of abrasion and/or state of wear of the run-in and run-out pulleys.

In particular, the construction of the wear monitoring system can be simplified if the parameter measuring device comprises a current and/or voltage measuring device for measuring at least one parameter in the form of a drive current and/or a drive voltage of the drive unit. The system components which are driven directly or indirectly by the at least one drive unit have a direct or indirect influence on the current and/or voltage waveforms of the drive unit in dependence on the time. For example, an electrical parameter can be determined more easily from a drive unit associated with a friction wheel assembly used for the purposes of accelerating and braking the gondola cars of the transportation system in order to synchronize them with the rotational speed of a circulating cable because abrasion in a friction wheel leads to a change in the power being drawn by the at least one drive unit and thus to a change in the current and/or voltage waveform of the drive unit. In addition, a correlation or a redundancy measurement can also be achieved by additionally detecting a mechanical parameter of one or more friction wheels of the friction wheel assembly for example.

Advantageously, the at least one system component is in the form of a cable pulley, a cable sheave, a friction wheel or a drive belt. In principle, it is possible to monitor every moveable component in the system and thereby establish the wear or abrasion at any point in the transportation system.

The construction of the wear monitoring system is particularly simple if the at least one reference component is in the form of a cable pulley, a cable sheave, a friction wheel or a drive belt. In this way, the same parameter measuring devices can be used in order to detect the actual values of the parameters of the system component and the reference component, whereby each component of the transportation system that is used as a reference component can itself also be a system component that is to be monitored.

It is expedient, if the cable sheave is in the form of a deflection sheave or a drive sheave. Cable sheaves of this type are employed, in particular, in cable car systems and lift systems. They have the advantage that they have a significantly greater diameter in comparison with the cable pulley assemblies on the masts of the transportation system and thus have a significantly lower rotational speed during the operation of the transportation system. Thus, in particular, the abrasion of drive or deflection sheaves is significantly lower than that of cable pulleys. Consequently, cable sheaves of large diameter in particular are outstandingly suitable as reference components.

It is advantageous, if a state of abrasion determining device is provided for determining the state of abrasion and/or the state of wear of the at least one system component in dependence on the parameter deviation and/or the change of the parameter deviation. The state of abrasion and/or the state of wear can thus be detected directly by the state of abrasion determining device.

Moreover, it is advantageous, if an operational reliability state determining device is provided for determining the operational reliability state of the transportation system in dependence on the state of abrasion and/or the state of wear of the at least one system component. By using this device in particular, one can detect as to whether or not the operational reliability state of the transportation system is such that it can continue to be used safely.

Preferably the operational reliability state determining device is configured so that an operational reliability state of the transportation system can be associated with the state of abrasion and/or the state of wear of the at least one system component determined by the state of abrasion determining device. Then, for example, if the state of abrasion and/or the state of wear of a system component exceeds a certain value, an operational reliability state can be associated with or assigned to the transportation system for indicating that safe operation of the transportation system can no longer be ensured. It is also possible to provide the data regarding the operational reliability state in a gradated form for example on a scale from 0 to 10, upon which a state of high operational reliability is or will be indicated by 10 whereas a state of minimum operational reliability is denoted by 0. The state of abrasion and/or the state of wear of a plurality of the system components can be used for the determination of the operational reliability state. The larger the number of system components being monitored, so the greater the precision with which a fault diagnosis of the transportation system can be accomplished. Thus, the position of a fault in the system can be located with particular accuracy by appropriate correlation of the actual values or actual value functions that have been detected at different system components. Accordingly, appropriate counter measures can then be taken such as those of shutting down the system and displaying a message identifying the defective system component for example.

In order to allow the operating personnel to be made aware of the operational reliability state, it is expedient to provide a comparison scale for quantifying the operational reliability state, and for an operational reliability state signal generating device to be provided for producing an operational reliability state signal which corresponds to a value of the operational reliability state on the comparison scale that is associated with the state of abrasion and/or the state of wear of the at least one system component. The comparison scale can be designed in a variety of ways, for example, in the form of a numerical scale ranging from 0 to 10 or the like, but it could also be a corresponding scale of colours wherein an operational reliability state which permits safe operation of the transportation system is indicated particularly in green, but wherein an operational reliability state in which the transportation system should not be operated at all is indicated in red.

In order to enable a high level of redundancy and certainty to be achieved in the process of determining the operational reliability state, it is advantageous for the operational reliability state signal generating device to be formed in such a manner that the parameter deviations derived from at least two system components can be processed for the purposes of producing the operational reliability state signal. The process for determining the operational reliability state will be so much more precise and more efficient, the greater the number of system components that are being monitored for determining the parameters thereof.

In order to enable that system component showing the greatest amount of abrasion to be filtered out, it is advantageous for the operational reliability state signal generating device to comprise a maximum value detecting unit with which there can be determined a maximum value of at least two detected parameter deviations and/or changes therein. This has the especial advantage that the largest overall deviation of a parameter or change thereof can be determined in this way, since the doubt is not as to whether the system components that are being monitored are abrading evenly, but rather, in finding out where the largest amount of abrasion and the largest amount of wear is occurring, because the operational reliability of the transportation system may already be in question due to corresponding damage or stoppage of just a single component in the system. The detection of this system component is simplified significantly by the use of the maximum value detecting unit.

In order to enable the operating personnel of the transportation system to establish in a simple and certain manner as to whether the system can continue to be used or whether it would be better to shut it down, it is expedient to provide an optical and/or acoustic indicator device for displaying the operational reliability state signal. For example, this can be in the form of a monitor and/or a loudspeaker so that the comparison scale and also the detected operating state can be displayed or signalled acoustically.

In order to signal to the operating personnel directly that an operational reliability state has reached a critical value which would sensibly entail a reduction in the operating speed or shut down of the transportation system, it is advantageous for an alarm device to be provided for producing an alarm and/or a shut down signal if the value of the operational reliability state signal exceeds at least one limiting value.

In order to enable the sensitivity of the system to be adjusted in a simple manner, it is advantageous for the at least one limiting value to be settable at a fixed value and/or to be alterable individually. Furthermore, the limiting value can also serve to define the corresponding response time for the system. Hereby, it can be expedient for the limiting value to be set in such a way that fluctuations, which may possibly be occurring in the actual values or actual value functions that are being detected by the parameter measuring device, are determined over a time interval and averaged if necessary in order to prevent unwanted errors (i.e., in particular, the production of shut down signals which are only being produced because of operation-dependent fluctuations in the transportation system), but not however because of abrasion or wear in the individual system components that are actually to be monitored.

In order for the operating personnel to know immediately that the transportation system has reached a critical operational reliability state or that it would be best for it to be shut down immediately, it is expedient to provide an optical and/or acoustic alarm signal display device for indicating the alarm and/or shut down signal. This, for example, can be in the form of a warning lamp or a flashing lamp and could also be formed by an appropriate loudspeaker or loudspeaker system.

In accordance with a preferred embodiment of the invention, provision may be made for the alarm system to cooperate with a control and/or regulating device for the at least one drive unit of the transportation system and to be configured so that the drive speed of the transportation system can be reduced and/or the at least one drive unit of the transportation system can be switched off as a result of the production of the alarm or shut down signal. The control of the transportation system can be completely automated in this way. The operation of the transportation system can thus be stopped immediately should a critical operating situation be established by the wear monitoring system irrespective of whether the operating personnel take notice of the alarm or shut down signal.

In order to enable the actual value and the desired value to be directly compared with one another for example, it is expedient for the parameter measuring device to be configured so that two or more electrical and/or mechanical parameters can be determined simultaneously. In particular in the case where the desired values or the desired value functions are determined by detecting the actual values and the actual value functions at the reference components, a parameter deviation can then be detected directly, for example, by forming the difference between the detected values directly.

Preferably, the parameter measuring device is configured that the actual value of the at least one parameter can be determined in time-dependent manner. Changes in the deviations of the parameter in the course of the operation of the transportation system and/or over a given time interval can thus be determined in a simple and certain manner.

The sensitivity of the wear monitoring system can be set, in particular, by virtue of the fact that the duration of the time interval can be preset and/or variable. The time interval can also be selected as an integral multiple of the operating cycles of the at least one system component or a reference component, and in particular, a certain number of rotations of a cable pulley or a cable sheave for example. A certain response time of the wear monitoring system can also be preset by the duration of the time interval if the values are determined and processed as average values over the time interval.

It is expedient for the parameter measuring device to be configured for the contactless measurement of the at least one parameter. Additional wear caused by the process of taking measurements of the parameters of the system components can thus be prevented in a simple and certain manner.

The construction of the parameter measuring device is particularly simple if it comprises a clock pulse emitting member which is connectable in mutually non-rotatable manner to the at least one system component for which the mechanical movement magnitude is to be determined, and at least one sensor for detecting the rotation of the clock pulse emitting member.

Both the rotational speed and the angular speed of the at least one system component can be determined in a simple and certain manner if the clock pulse emitting member is in the form of a timing disc having a multiplicity of clock members arranged regularly around the periphery of the timing disc, whereby the movement thereof can be detected in a simple and certain manner by appropriate sensors.

The construction of the timing disc is particularly simple if the clock members are in the form of radially outwardly or radially inwardly protruding projections which form a regular toothing. Preferably, the toothing can thus be in the form of an external or internal set of teeth. In addition, a timing disc formed in such a manner can ensure the operational reliability of the parameter measuring device.

In order to enable the parameter to be measured in a simple and certain manner with the aid of proximity sensors for example, it is advantageous for the clock pulse emitting member to be at least partly made of a metal.

In order to ensure the operational reliability of the parameter measuring device even when it is exposed to the effects of the weather, it is advantageous for the clock pulse emitting member to be provided with an anti-freeze layer. The clock pulse emitting member can thus be prevented from becoming iced up in which case the determination of a mechanical parameter of the at least one system component, the magnitude of a movement thereof for example, could no longer be ensured.

The construction of the timing disc is particularly simple and economical if the anti-freeze layer is made of a synthetic material.

The movement magnitude of the at least one system component or reference component can be measured in a simple and certain manner if the sensor is an inductive or a capacitive proximity sensor or a Hall sensor. With the aid of the latter in particular, pulses can be produced due to the movement of the clock members past the sensor so that the rotational speed or the angular speed of the timing disc and also the speed of the at least one system component or that of the reference component can be derived therefrom.

In accordance with a preferred embodiment of the invention, provision may be made for the at least one reference component and the at least one system component to be configured so that, in the starting state occurring when the system is started-up for example, the value of the first movement magnitude is smaller than that of the at least one second movement magnitude. Thus, for example, a ratio of the first and second movement magnitudes relative to one another can be determined which will have a value significantly smaller than 1 or a value significantly larger than 1 in dependence on the way in which the ratio of the two magnitudes is formed. The rotational speeds of system components and reference components could be mentioned as examples. If a deflection sheave or a cable sheave having a very large diameter is provided as a reference component, then, in the case where the cable speed is the same, this will have a significantly lower value of rotational speed than a cable pulley of comparatively significantly smaller diameter. In consequence, the actual value function of the reference component will change to a significantly lesser extent over the course of time than the actual value function of the system component that is to be monitored.

Expediently, a radius of the at least one reference component is greater than a radius of the at least one system component. The smaller the radius of the system component, then the greater the abrasion thereof in the course of time at a constant cable speed compared with a system component of larger radius. The latter is therefore particularly well suited as a reference component having a significantly more constant waveform for the actual value of its measured parameter over the course of time.

Furthermore, it is suggested to use of one of the wear monitoring systems described above for monitoring the wear and/or the abrasion of a system component of a cable operated transportation system comprising a support cable and/or a traction cable and/or a hoisting cable and also at least one drive unit, wherein said system component is mounted in rotating and/or circulating manner.

The present invention does also relate to a cable operated transportation system comprising a cable, at least one drive unit for moving the cable and at least one system component which is mounted in rotating and/or circulating manner for driving and/or guiding the cable or other components of the transportation system, characterised by a wear monitoring system for monitoring the wear and/or the abrasion of the at least one system component which is subjected to wear and/or abrasion and is mounted in rotating and/or circulating manner, which wear monitoring system comprises a parameter measuring device for measuring an actual value and/or a time-dependent actual value function of at least one electrical and/or mechanical parameter of the at least one system component and/or the drive unit and also comprises an evaluating device for determining a parameter deviation of the actual value from a desired value in dependence on time or a time interval and/or a deviation of the actual value function from a time-dependent desired value function of the at least one parameter, which parameter deviation corresponds to the state of abrasion and/or the state of wear of the at least one system component.

In dependence on the design of the wear monitoring system, a cable operated transportation system equipped with such a wear monitoring system provides the opportunity to specifically monitor individual system components for wear and/or abrasion and thus obtain in good time an indication as to when it would be logical to maintain or replace the particular system component in order to prevent damage to the transportation system and ensure the operational reliability of the transportation system over a long period.

Preferably, the wear monitoring system is in the form of one of the wear monitoring systems described above and is constructed in correspondence with the previously described further developments thereof and thus it also exhibits the advantages that have already been described above.

The invention also relates to a method for monitoring the wear and/or the abrasion of at least one system component which is subjected to wear and/or abrasion and is mounted in rotating and/or circulating manner and forms part of a cable operated transportation system comprising a support cable and/or a traction cable and/or a hoisting cable and also at least one drive unit, wherein an actual value and/or a time-dependent actual value function of at least one electrical and/or mechanical parameter of the at least one system component and/or the drive unit is measured and wherein there is determined a parameter deviation of the actual value from a desired value in dependence on time or a time interval and/or a deviation of the actual value function from a time-dependent desired value function of the at least one parameter, which parameter deviation corresponds to the state of abrasion and/or the state of wear of the at least one system component.

The method proposed is simple to carry out and concentrates on determining the deviation of a parameter either at the system component itself or indirectly, by determining such a deviation in at least one drive unit of the transportation system, whereby the wear and/or abrasion of the at least one system component can be determined directly or indirectly. The state of abrasion and/or the state of wear of the particular system component that has been detected in this way can also be used, in particular, for taking appropriate measures in order to ensure the operational reliability of the transportation system, for example, by maintaining or repairing the system component or decreasing the speed of circulation of the transportation system or even shutting it down.

It is expedient, if the actual value and/or the actual value function of at least one mechanical-parameter-defining first movement magnitude of the at least one system component is measured. The advantages of this arrangement are immediately apparent, as too are the advantages of all the further embodiments of the method that are described in the following, from the above description of the advantages of the wear monitoring system that has been proposed in accordance with the invention.

It is advantageous, if the actual value and/or the actual value function of at least one mechanical-parameter-defining second movement magnitude of at least one reference component of the transportation system which is mounted in rotating and/or circulating manner is measured.

Expediently, a parameter-deviation-defining movement magnitude deviation of the actual value and/or the actual value function of the at least one movement magnitude and of the at least one second movement magnitude from one another is determined.

In accordance with a special variant of the method proposed in accordance with the invention, provision may be made for a change of the parameter deviation in dependence on the period of operation or an operating interval of the transportation system to be determined, which change of the parameter deviation corresponds to the state of abrasion and/or the state of wear of the at least one system component in dependence on the period of operation or the operating interval.

The method can be carried out in a particularly simple manner if the mechanical parameter is measured in the form of a torque, a rotational speed or an angular speed.

Preferably, the at least one parameter is measured in the form of a drive current and/or a drive voltage of the at least one drive unit. These parameters enable a conclusion to be drawn indirectly as to the wear and/or abrasion of the at least one system component.

Advantageously, the at least one parameter is measured at a cable pulley, a cable sheave, a deflection sheave, a drive sheave, a friction wheel or a drive belt. In this way in particular, a desired value or a desired value function can also be measured directly at one of the abovementioned parts of the transportation system and then compared with the parameter of the system component that is to be monitored whereby a parameter deviation can thus be determined.

It is advantageous, if the state of abrasion and/or the state of wear of the at least one system component is determined in dependence on the parameter deviation and/or the change of the parameter deviation.

It is expedient, if an operational reliability state of the transportation system is determined in dependence on the state of abrasion and/or state of wear of the at least one system component.

In order to receive a direct indication as to the operational reliability state, it is expedient if the ascertained state of abrasion and/or the state of wear of the at least one system component is associated with the operational reliability state of the transportation system.

Preferably, there is produced an operational reliability state signal which corresponds to a value of the operational reliability state on a comparison scale which is associated with a state of abrasion and/or a state of wear of the at least one system component.

In order to increase the quality of the process of evaluating the operational reliability state of the transportation system, it is expedient if the parameter deviations derived from at least two system components are processed for the purposes of producing the operational reliability state signal.

Since the operational reliability of a transportation system can be called into question even if there is a breakdown of or damage to just one system component, it is advantageous if the maximum value of at least two detected parameter deviations and/or changes therein is determined. In this way one can avoid the problem that in certain circumstances it will only be the average value of the state of wear or the state of abrasion that is determined, even though this value does not necessarily take into consideration that a particular one or more of the system components has already been damaged to such an extent that the operational reliability of the transportation system as a whole can no longer be ensured.

Expediently, the operational reliability state signal is indicated optically and/or acoustically.

Preferably, an alarm and/or a shut down signal is generated if the value of the operational reliability state signal exceeds at least one limiting value. Several limiting values for the operational reliability state signal could also be preset, whereby differing levels for the operational reliability state of the transportation system can be predefined. For example, a first limiting value could indicate that maintenance of a particular one or more system components would make good sense, effectively a reminder in regard to an operationally dependent maintenance interval. A next limiting value could, for example, indicate that a system component is exhibiting maximum abrasion or maximum wear and must be replaced immediately in order to ensure the operation of the transportation system in the light of the current safety regulations. Furthermore, another limiting value could be selected in such a way that when it is exceeded, an indication is given that the transportation system is to be shut down immediately or is shut down immediately.

In order to preset the response times for the monitoring of the transportation system individually and also to enable the sensitivity of the wear monitoring system to be set and adjusted in accordance with the particular requirements, it is advantageous for the at least one limiting value to be settable at a fixed value and/or for it to be alterable individually.

Advantageously, the alarm and/or shut down signal is indicated optically and/or acoustically.

Furthermore, it can be expedient if, following the generation of the alarm signal and/or shut down signal, the drive speed of the transportation system is reduced and/or the at least one drive unit of the transportation system is switched off.

Preferably, two or more electrical and/or mechanical parameters are determined at the same time. This makes it possible for the state of abrasion and/or the state of wear of individual system components to be detected practically in real time and to be used for the control and/or regulation of the transportation system accordingly.

In order to enable the variation over time of the parameter deviation to be determined, it is advantageous for the actual value of the at least one parameter to be measured in time-dependent manner.

Expediently, the duration of the time interval is preset at a fixed amount and/or is variable as required in order to predefine the response time and the sensitivity of the method.

Advantageously, the at least one parameter is measured in contactless manner.

Moreover, it can be expedient for the at least one reference component and the at least one system component to be selected in such a way that, in the starting state occurring when the transportation system is started-up, the first movement magnitude has a smaller value than the at least one second movement magnitude.

A cable operated transportation system in the form of an aerial ropeway bearing the general reference symbol 10 is schematically illustrated at least in part in the Figures. It comprises a circulating, driven cable 12 having chairs or gondola cars 14*a* for the transportation of people or load-carrying gondola cars 14*b* for the transportation of goods arranged thereon such that they are either fixed to the cable 12 or are only connected thereto temporarily in order to temporarily release the gondola cars 14*a* for the transportation of people in particular from the cable and thereby make it easier for a number of people to get into or out of them. A first drive unit in the form of a drive means 16 is formed and arranged in such a manner that the cable 12, which is preferably an endless one, can be moved so as to move the gondola cars 14*a* or 14*b* in a circulatory manner through the transportation system 10.

Pulley assemblies 18 which are held on the support masts 20 are provided for the guidance of the cable 12. The pulley assemblies 18, which are also referred to as roller-groups, comprise a plurality of cable pulleys 22. In the exemplary embodiment of a transportation system 10 illustrated in the Figures, each pulley assembly 18 comprises four cable pulleys 22. These form the rotationally mounted system components subject to wear and/or abrasion in the sense of the Claims. In each case, two cable pulleys 22 are arranged together in a rocker member 24 on which they are rotatably mounted, the rocker member being mounted such that it is pivotal relative to a cross beam 26 at a free end of the support mast 20. The rocker members 24 are inclined relative to the cross beams 26 to a greater or lesser extent in dependence on the size of the load on the cable 20 that is produced by the gondola cars 14*a* or 14*b* in a span 28 between two pulley assemblies 18. The larger the load on the cable 12 produced by the gondola cars 14*a* or 14*b* in the span 28, the greater the inclination as is illustrated in exemplary manner in FIGS. 1 and 2.

The pulley assemblies 18 can be in the form of supporting pulley assemblies. The cable 12 rests upon the cable pulleys 22 of the pulley assembly 18 in pulley assemblies 18 of this type, as is illustrated in FIGS. 1 and 2. Alternatively, the pulley assemblies 18 could also be in the form of holding down pulley assemblies, where the cable 12 is held down by the pulley assembly 18 and presses against the pulleys 22 in a direction opposed to the force of gravity. For example, the schematic illustration in FIG. 3 corresponds to a view of a pulley assembly 18 in the form of a holding down pulley assembly from below.

The cable pulleys 22 are provided with a peripheral radially outwardly open cable guide groove 30 in the form of a guide slot which defines a cross section in the form of a segment of a circular arc. The cable pulley 22 is usually made with a metal core which is provided with a layer of synthetic material consisting of hard rubber and/or an elastomer for example, which surrounds the cable pulley 22 in the circumferential direction and is of sufficient thickness as to enable the cable guide groove 30 to be easily worked into the hard rubber layer. Since the cable 12 is usually made of a metal, this results in the cable 12 and the cable pulley 22 having different abrasion properties here, whereby the wear and/or abrasion of the cable pulley 22 is usually greater than that of the cable 12. If there are no externally effective side forces acting on the cable 12, then, as illustrated in FIG. 4, the cable 12 lies in the cable guide groove 30 such that it is symmetrical relative to a central plane which extends perpendicularly relative to the axis of rotation 32 about which the cable pulley 22 is rotatably mounted. The effective radius of the cable pulley 22 is defined by the distance r between the axis of rotation 32 and a tangent 34 to the cable guide groove 30 which is parallel to the axis of rotation 32.

Abrasion and/or wear of the cable pulley 22 can occur due to the wind particularly in a storm, and also due to the swaying of the gondola cars 14*a* or 14*b*, whereby transverse forces $\vec{F}_q$ such as are illustrated in FIG. 3 can occur and these can deflect the cable from the described rest position which is illustrated in FIG. 4. This is schematically illustrated in FIGS. 3 and 6. In essence, a deflection of the cable 12 from its rest position is manifested by the cable 12 being pushed up laterally onto an inner surface 36 of the cable guide groove 30 so that the distance of the cable 12 from the axis of rotation 32 changes. This results in the cable 12 having a larger effective radius (i.e., r+Δr, in the deflected state thereof). This radius is defined by the distance between a not illustrated point where the cable 12 touches the inner surface 36 of the cable guide groove 30 taken with reference to the axis of rotation 32. This touching point is defined by a further tangent to the cable guide groove 30. The larger the transverse force $\vec{F}_q$ effective on the cable 12, the further the cable 12 is deflected from the rest position. In the worst case, the cable 12 completely leaves the cable guide groove 30, and jumps off the cable pulley 22. The danger of such a cable dislodgement becomes the greater, the larger the transverse forces $\vec{F}_q$ that are effective on the cable 12. The position of the cable 12 in the cable guide groove 30 is determined on the one hand by the transverse force $\vec{F}_q$ and, by the restoring force $\vec{F}_r$ applied by the cable roller 22 on the other. In dependence in each case on the effective transverse force $\vec{F}_q$, an equilibrium sets in and thus there is an effective radius r+Δr. The effective radius r+Δr as increased by the deflection of the cable 12 from the rest position acts in direct opposition to a decrease of radius resulting from abrasion of the cable pulley. Consequently, when determining the parameter deviation for the purposes of detecting the state of abrasion and/or the state of wear of the cable pulley, one should preferably also take into consideration as to whether a change of the rotational speed of the cable pulley 22 due to abrasion for example has possibly been completely or partially compensated by a change in the position of the cable 12 in the pulley due to transverse forces. A change in the position of a cable therefore represents a disturbance variable.

The largest deflection of the cable 12 from the rest position is apparent at those cable pulleys 22 of the pulley assemblies 18 which define the run-in pulleys 40 and the run-out pulleys 42. The run-in pulley 40 is formed by that cable pulley 22 onto which the cable 12 runs-in from the span 28 in the direction of movement 44, the run-out pulley 42 is defined by the cable pulley 22 from which the cable 12 runs into the span 28 in the direction of movement 44. Common to the run-in pulley 40 and the run-out pulley 42 of the pulley assembly is that neighbouring them, there is arranged just one further cable pulley 22 in each case. The two other cable pulleys 22 of the pulley assembly 18 form so-called inner pulleys which are also referred to hereinafter as reference pulleys 46 and can be defined as reference components in the sense of the Claims. The inner pulleys are defined in such a way that they are arranged between two neighbouring cable pulleys 22, in the present exemplary embodiment of the roller assembly 18, between the run-in pulley 40 and a cable pulley 22 or between a cable pulley 22 and the run-out pulley 42.

In the transportation system 10, wear of the cable pulleys 22 can occur not only in the form of abrasion of an outer rubber layer for example, but also for example, from jamming of the bearings of the cable pulleys 22. The consequence of this in the worst case is that the cable pulley 22 no longer rotates and the cable 12 is pulled over the cable pulley 22, whereby the cable guide groove 30 does not wear out evenly, but is abraded on only one side. The consequence of this is that the effective radius r of the cable pulley 22 does not remain constant around the periphery thereof but rather, varies in dependence on the angle of rotation. A further form of wear is to be seen in the fact that the outer rubber coating of the cable pulley 22 separates in its entirety from the cable pulley in an undesirable manner.

In the transportation system 10 however, wear can also occur at a cable sheave 48, namely, both in the case of a drive sheave that is being driven by the drive means 16 and in the case of a non-driven deflection sheave which serve to change the direction of travel of the cable 12 through 180° for instance at the ends of the transportation system 10. Wear can also occur at the cable sheaves 48 either due to the cable sheave 48 sticking or due to abrasion of an outer layer of the cable sheave 48 which, in principle, is constructed in analogous manner to that illustrated in FIG. 4 (i.e., it likewise comprises a cable guide groove for securely guiding the cable 12).

Common to all the types of wear and abrasion described thus far, is that the effective radius of the cable pulleys 22 or the cable sheaves 48 alters in the course of time, namely in particular, it is reduced with the consequence that the rotational speed of the cable pulleys 22 gradually increases for a constant speed of the cable. In the case of cable sheaves 48, their effective radius r likewise becomes smaller due to abrasion, but here however, the consequence is that the cable speed slowly decreases when the angular speed of the drive remains constant.

For the purposes of determining the abrasion and/or wear of individual rotating and/or circulating system components, there serves a wear monitoring system 38 which is schematically illustrated in FIG. 6. It comprises at least one parameter measuring device 50 which is assigned to a cable pulley 22 or a cable sheave 48. In the exemplary embodiment illustrated in FIG. 6, a parameter measuring device 50 is assigned to each cable pulley 22, whilst a further parameter measuring device 50 is optionally also assigned to each cable sheave 48. Each one of the parameter measuring devices 50, which form the movement magnitude measuring devices in the sense of the Claims, comprises a clock pulse emitting member 52 in the form of a timing disc which is connected in mutually non-rotatable manner to the respective cable pulley 22 or cable sheave 48, and also a sensor 54 such as a capacitive or inductive proximity sensor or a Hall sensor for example, with which a rotational movement of the clock pulse emitting member can be detected. However, encapsulated incremental or absolute position-measuring systems can also be utilised as the parameter measuring devices 50. The timing disc is in the form of a flat metallic annulus 56 which is provided at the outer edge thereof with a toothing 60 comprising a plurality of clock members in the form of projections forming teeth 58. The annulus 56 illustrated schematically in FIG. 5 for example is provided with a central circular through hole 62 in which there is formed a recess 64 of square cross section that points in the direction of the centre of the through hole 62, and engaging in said recess there is a not illustrated, corresponding projection of a bearing shaft of the respective cable pulley 22 or cable sheave 48 which causes the clock pulse emitting member 52 to rotate at the same rotational speed as the cable pulley 22 to which it is assigned. Alternatively, the timing disc could also be stuck firmly to the cable pulley 22 or the cable sheave 48 or it could be completely integrated therein (i.e., form a complete entity therewith).

The annulus 56 provided with the toothing 60 is provided with an anti-freeze layer 66 in the form of a coating of synthetic material which prevents any possible formation of ice on the clock pulse emitting member 52.

The sensors 54 are attached to the pulley assembly 18 in such a manner that they can detect a movement of the teeth 58. They produce a clock pulse signal which is fed over signal lines 68 to an evaluating device 70. The evaluating device 70 can be arranged in the vicinity of the pulley assembly 18, on a support mast 20 for example. As an option, the evaluating device 70 could also be arranged in a control post 72 of the transportation system 10 as is illustrated in exemplary manner in FIG. 6. Optionally, a converter unit 74 can be connected between the sensor 54 and the evaluating device 70 for converting the signal generated by the sensor 54 into a rotational speed signal and supplying it to the evaluating device 70.

A movement magnitude of the respective cable pulley 22 such as the rotational speed or angular speed thereof for example can be determined with the aid of the parameter measuring device 50. The parameter measuring device 50 then forms either a rotational speed measuring device or an angular speed measuring device. The evaluating device 70 is configured so that the detected parameters can be compared therein and then, for example, a difference therebetween can be determined, namely, in the form of a parameter deviation, for example of the respective actual values of a cable pulley 22 in comparison with a reference pulley 46 or just a parameter deviation of an individual cable pulley 22 in dependence on the period of operation or a time interval. If, as a reference pulley 46, use is made of a cable pulley 22 which is subject to only a small amount of wear compared with other cable pulleys 22 due to its position in the transportation system 10, then for example, the parameter deviation could be determined in the form of a difference in rotational speed or a difference in angular speed between a cable pulley 22 that is to be monitored and the reference pulley 46. The more advanced the wear on the two pulleys, the smaller the effective radius r thereof, whereby the reduction in radius of the cable pulley 22 that is to be monitored and is subjected to a greater amount of abrasion will be larger than for the reference pulley. The consequence of this is that, in the course of time, there will be an increase in the detected difference in rotational speeds of the two pulleys. The actual value of the rotational speed of the reference pulley 46 can, for example, serve as the desired value for a cable pulley 22 the wear of which is to be monitored. If, for example, the effective radii r of the cable pulley 22 immediately after installation of the transportation system 10 and after it has been subjected to the greatest possible amount of abrasion are known, then the state of abrasion or state of wear of the respective cable pulley 22 can be determined directly from the parameter deviation.

Types of abrasion or wear can be determined directly from the detected parameter deviation. If the parameter deviation increases continuously in the course of time for example, then one can assume that this is due to a normal, even amount of wear or an even amount of abrasion. If, however, the parameter difference suddenly increases, one can assume with a high degree of probability that one of the two cable pulleys 22, namely, the one which is actually being monitored or the reference pulley 46 is no longer rotating because it is blocked by an extraneous effect or as a result of bearing failure for example. Uneven abrasion of the cable pulleys 22, which leads to the effective radius r varying over the peripheral extent of the cable pulley 22, can be recognized as a superimposed oscillatory function in the representation of the parameter deviation in dependence on time.

A radius r varying over the peripheral extent can also be due for example, to flexing of the inner layers of the outer tire body of the cable pulley 22 which is built up of different layers and materials. The plastic deformation of the tire body resulting from the flexing can occur, in particular, during the starting motion and braking of the cable 12.

Instead of the actual and desired values, actual value functions and desired value functions can also be specified or predefined, especially functions over certain preset or individually settable time intervals. This also enables the actual and desired value functions to be compared with one another if necessary in order to purposefully average out or not take into consideration large changes of parameter at individual cable pulleys which occur in isolation but are limited in time such as, for example, the accelerations and decelerations occurring in the case of the above described entry and departure of the gondola cars 14*a* and 14*b* from the span 28, this being something which leads to a pivotal movement of the rocker members 24 and thus to a short term acceleration or deceleration of the respective cable pulleys 22. For the purposes of such a time-dependent comparison, it is expedient to provide an averaging unit 75 with the aid of which actual and desired values can be compared in time-dependent manner, or, actual and desired value functions which are time-dependent can be compared so that time-dependent average values can be formed.

The parameter deviation that has been determined in this way corresponds to the state of abrasion and/or the state of wear of the at least one system component such as the cable pulley 22 or the cable sheave 48. It can also be used however, in order to indicate the operational reliability state of the transportation system 10. It would of course be conceivable and possible to individually indicate the state of abrasion of individual system components in an optical and/or acoustic manner, however, as safe operation of the transportation system 10 can only be ensured if the state of abrasion and/or the state of wear of all the system components lies in an appropriate range, it is more logical to directly determine and indicate the operational reliability state. For this purpose for example, an operational reliability state determining device 76 can be provided in the control station 72 which can also optionally include the evaluating device 70. The operational reliability state of the transportation system 10 can be determined in dependence on at least one detected parameter deviation with the aid of the operational reliability state determining device 76. To this end, a comparison scale 80 is preferably stored in a memory 78 of the operational reliability state determining device 76. The comparison scale 80 serves the purpose of enabling a value for the operational reliability state to be assigned to a particular detected value of a parameter deviation. Serving for this purpose, there is an operational reliability state signal generating device 82 with the aid of which an operational reliability state signal is produced which corresponds to the value of the operational reliability state on the comparison scale that is assigned to one or more of the detected parameter deviation(s).

An indicator device 84 serves for the optical and/or acoustic indication of the operational reliability state signal. The indicator device 84 can be in the form of a monitor and/or a loudspeaker for example.

Furthermore, the operational reliability state determining device 76 comprises an alarm device 86 for producing an alarm or shut down signal if the value of the operational reliability state signal exceeds a given limiting value which can be stored in the memory 78 for example. Furthermore, an alarm signal display device 88 can be provided for displaying the alarm signal. This could, in particular, also form part of a unit incorporating the indicator device 84. The alarm signal display device 88 serves to indicate the detected alarm and/or shut down signal optically and/or acoustically.

The alarm and shut down signal can be passed on by the operational reliability state determining device 76 to a control and/or regulating device 90 of the transportation system 10 which exerts an effect on the drive means 16 of the transportation system 10 in dependence on the value of the alarm and/or shut down signal, for example, by causing the speed to be reduced or by causing the drive means 16 or the transportation system 10 to be completely shut down in order to prevent a cable from being dislodged with the associated negative effects especially on the passengers for example.

Furthermore, the operational reliability state determining device 76 can comprise a cable position detecting device 92 for determining the position of the at least one cable pulley 22. A cable position detecting device 92 of this type is described in the German patent application 10 2007 006316.6 for example, this hereby being incorporated into the present application together with its entire published content.

Furthermore, the parameter measuring devices 50 are optionally formed in such a manner that the parameters of the cable pulleys 22 with which they are associated can preferably be detected therewith at the same time. Optionally, the operational reliability state signal generating device 82 can be formed in such a manner that the first and second parameters are determinable in time-dependent manner with the aid of the parameter measuring devices 50 and that the evaluating device 70 is formed in such a manner that an average deviation of the first parameter from the second parameter is determinable over a predefined time interval. This time interval can, in principle, be freely selected by the operator of the transportation system 10. For example, the time interval can be selected to lie within a range of 0.5 seconds up to 5 seconds. As a result of the average deviation of the parameter having being determined over a certain interval of time with the aid of the averaging unit 75 for example, fluctuations having a negligible effect upon any possible abrasion or wear can be averaged out so that an unnecessary reduction in speed or shut down of the transportation system 10 can be avoided in such cases. Furthermore, a maximum value detecting device 114 can be provided and with its aid the largest detected parameter deviation occurring at different system components of the transportation system 10 can be established. This process of detecting the largest parameter deviation permits action to be taken on the transportation system at precisely that moment when any particular system component is so damaged or worn-out that the operational reliability of the transportation system 10 can no longer be ensured.

Moreover, the operational reliability state device 76 can, furthermore, also comprise a data-processing system especially in the form of a computer for example, said computer being capable of embracing the functions of the evaluating device 70, the operational reliability state signal generating device 82, the averaging unit 75, the maximum value detecting unit 114, the alarm signal generating device 88 and also the cable position detecting device 92. An appropriate input device such as a keyboard for example, can be provided for entering the data. Furthermore, the data-processing system can be configured so that it is suitable for implementing the running of a computer program in order to implement any of the above described processes for monitoring the wear and/or the abrasion of at least one system component of the transportation system that is subjected to wear and/or abrasion and is mounted in rotating and/or circulating manner or a method such as is claimed in the corresponding method Claims. In particular, the computer program can be stored on a computer-readable medium and may comprise program code means which are suitable for implementing any of the processes described above or any of the claimed methods when the computer program is running on the data-processing system of the wear monitoring system 38. The computer-readable medium can, for example, be in the form of a data carrier in the form of a CD ROM, a diskette or a memory card for example.

In a cable operated transportation system 10 wherein the gondola cars 14*a* or 14*b* are not permanently connected to the cable 12, these gondola cars must be accelerated and/or decelerated to the running speed of the cable for the purpose of connecting them to the cable or for releasing them from the cable. Serving to this end are the friction wheel assemblies 96 incorporating a plurality of friction wheels 98 which are schematically illustrated in FIG. 7 and are connected one behind the other and driven by means of transmission belts 100 which form circulating system components that are subjected to wear or abrasion. Particularly suitable transmission belts 100 are drive belts which are guided over belt pulleys 102 and 104 that are firmly connected to the respective friction wheels 98. The driving process effected by means of the transmission belts 100 is of the type wherein successive friction wheels 98 have a bigger or smaller rotational speed in dependence on whether the friction wheels 96 are intended to form an acceleration or a deceleration stretch. Accordingly, step-up or step-down transmission ratios are formed by the arrangement of the transmission belts 100 in conjunction with the belt pulleys 102 and 104. Here, a transmission belt 100 coupling two friction wheels 98 runs over a small belt pulley 102 on the one friction wheel 98 and over a larger belt pulley 104 on the coupled friction wheel 98. Each friction wheel preferably has a small and a larger belt pulley 102, 104.

Problems in a friction wheel assembly 96 can occur if, for example, one of the friction wheels 98 shows a reduction of air pressure in the case of air-filled friction wheels, or if it is covered with dew or hoarfrost for example. The consequence of this is that the driving power of the friction wheel 98 can only be transferred to the gondola car 14*a* to a reduced extent. As a result, the forces and torques in the entire drive chain are also reduced whilst the gondola car 14*a* is passing this friction wheel 98. The friction wheel assembly 96 is preferably driven by a separate drive unit 106 which propels a drive wheel 108 that is coupled by means of a belt 110 to a first friction wheel 98*a* of the friction wheel assembly 96. Alternatively, it is also possible to dispense with the drive unit 106 and let the friction wheel assembly be driven by the drive means 16 of the cable 12, for example, by means of cardan shafts or belts. The effect of an impaired friction wheel 98*c* on the drive current I can, in particular, be detected in a parameter measuring device 50 in the form of a current measuring device for example, due to the middle friction wheel 98*c* transferring only a reduced amount of drive power to the gondola car 14*a*. As a result of the larger amount of slippage of the friction wheel 98*c*, the rotational speed thereof increases when the gondola car 14*a* is passing over the friction wheel 98*c* whereby the motor current I increases or decreases. In other words, a parameter deviation occurs which can be directly associated with the state of abrasion and/or state of wear of the respective friction wheel, in the present case, the friction wheel 98*c*. Alternatively, the rotational speed or the speed of revolution $\vec{V}(\vec{x})$ of the friction wheel 98*f* furthest from the drive unit could also be determined with the aid of a suitable parameter measuring device. The functionally impaired friction wheel 98*c* then causes the speed profile $\vec{V}(\vec{x})$ to alter relative to a desired curve in dependence on the position x of the gondola car 14*a* in the region of the friction wheel assembly 96. This deviation from the illustrated dotted desired curve of the speed profile $\vec{V}(\vec{x})$ is illustrated in the lower part of FIG. 8 and is apparent from the decrease in the speed of revolution of the friction wheel 98*f* which is depicted by the solid-line and occurs at the precise moment when the gondola car 14*a* is passing the friction wheel 98*c*.

Transmission belts 100 are also subject to wear and/or abrasion, for example, by virtue of being overstretched or due to them slipping such as can occur as a result of soiling or the formation of dew. In the case of a deceleration stretch such as is illustrated in exemplary manner in FIG. 9 wherein the transmission belt 100*b* is defective, the rotational speed of the drive unit 106 increases when the gondola car 14*a* reaches the friction wheel 98*c* which is no longer being driven ideally by the defective transmission belt 100*b*. This thus results in a rotational speed or speed of revolution $\vec{V}(\vec{x})$ of the friction wheel 98*f* which is dependent on the position of the gondola car 14*a* in the region of the friction wheel assembly 96. After passing the defective transmission belt 100*b*, the actual rotational speed (depicted by the solid line) of the friction wheel 98*f* lies continuously above the expected desired curve (depicted by the dotted lines), namely, due to the interrupted drive chain.

The detected movement magnitude deviation (i.e., the deviation of the desired curve from the actual curve) which is illustrated below the friction wheel assemblies 96 for the respective examples shown in FIGS. 8 to 10, does not just arise temporarily in the case of a defective transmission belt 100 (i.e., whilst passing the transmission belt), as was the case for the defective friction wheel 98*c* that was described in conjunction with FIG. 8, but rather it takes place over a larger or longer section of the friction wheel assembly 96. Here, there is also a deviation in the motor current I of the drive unit 106 which is directly detectable with the aid of the parameter measuring device 50. A parameter deviation could also be effected directly by a measurement of the rotational speed of a plurality or all of the friction wheels 98, whereby one would come to the same conclusions which would enable redundancy of the system. In all, due to the respective impairment, there can be established a deviation of the actual values or actual value functions, which are illustrated in FIGS. 8 to 10 by the solid lines, from the desired values or the desired value function, which are illustrated in the Figures by the dotted lines.

For the sake of completeness yet another example of an acceleration stretch is illustrated schematically in FIG. 10. As a result of increased slippage of the middle transmission belt 100*c*, the rotational speed or the speed of revolution $\vec{V}(\vec{x})$ of the most distant friction wheel from the drive unit 98*a*, which is illustrated in FIG. 10 in dependence on the position of the gondola car 14*a* within the friction wheel assembly 96, is below the dotted desired curve. As a consequence thereof, the gondola car 14*a* is not accelerated as much as desired. It is only after the gondola car 14*a* has passed the worn section containing the defective transmission belt 100*c* that the desired level of acceleration occurs, one being able to recognise this from the coincidence of the preferred and actual curves. Here too, it is possible for the defect to be detected directly from the drive current I of the drive unit 106 using the parameter measuring device 50.

In all three of the cases described, the location of the malfunctioning section can be detected by means of a temporal or spatial correlation between the entry of the gondola car 14*a* into the acceleration or deceleration region and the measured rotational speed or speed deviation at the friction wheel 98*f* or 98*a* which is furthest from the drive unit or a change in the level of the operating current. One can distinguish between an individual defect in a friction wheel 98 and a defect in a transmission belt 100 from the differing shapes of the signal. Optionally, instead of the rotational speed and the motor current measurements, measurements could also be made of the torque at the friction wheels 98 in order to determine the wanted parameter deviation.

An example of a possible operational sequence for determining the operational reliability state of the transportation system 10 is schematically illustrated in FIG. 12.

Once the transportation system 10 has started operating, at least one first parameter, such as the rotational speed(s) of the run-in pulley 40 or the run-out pulley 42 or of a friction wheel 98 or the motor current I of the drive unit 106 for example, is (are) determined with the aid of the parameter measuring device(s) 50. Optionally, a second parameter such as the rotational speed of a reference pulley 46 for example can be determined with the aid of a further parameter measuring device 50. A measurement that is particularly well suited for this purpose, is the measurement of the rotational speed of a cable sheave 48 which, due to its larger diameter, rotates at a significantly lower and altogether more constant rotational speed over the period of operation than the individual small cable pulleys 22. Preferably, the first and second parameters are measured at the same time. The parameter deviation between the first and second parameters is determined with the aid of the evaluating device 70. The second parameter could also be a given parameter in the form of a desired value or a desired value function. The parameter of the system component that is to be monitored can be measured as a time-dependent actual value or as an actual value function.

The thus determined parameter deviation corresponds to the state of wear or state of abrasion of the respectively monitored system component and this can be determined and indicated with the aid of a state of abrasion determining device 112.

In the next step, an operational reliability state signal is generated in dependence on the detected parameter deviation. If a plurality of parameter deviations have been determined, then the actual operational reliability state will be influenced to the greatest extent by the most severely damaged one of the system components being monitored. Optionally, the operational reliability state signal can be indicated optically and/or acoustically with the aid of the indicator device 84. This can be done in such a manner that a text message indicating the operational reliability state (e.g., "no malfunction" or "high abrasion" is displayed on a monitor). The indicator could also display the operational reliability state signal in the form of a bar line display which, additionally, could be in colour such as for example, a green display for representing an operational reliability state in which nothing is malfunctioning, a yellow display in the case where there is a minimal danger of a malfunction and a red display in the case of severe abrasion or heavy wear. The operational reliability state signal is produced using an appropriate association with the assistance of the comparison scale on the basis of the measured parameter deviation.

In order to produce an effect on the operation of the transportation system 10, the operational reliability state signal is compared with a presettable limiting value. If the operational reliability state signal is smaller than the limiting value, then operation of the system continues unchanged (i.e., the first and/or the second and any further parameters continue to be measured as described above).

However, if the comparison of the operational reliability state signal with the limiting value indicates that the limiting value has been exceeded, then an alarm signal is preferably generated by the alarm device and is indicated optically and/or acoustically with the aid of the alarm signal display device 88 for example. The indication could, in particular, be in the form of a full text display showing data such as "reduce speed" or "switch off the drive" or "shut down the system" for example. In dependence on the amount by which the limiting value was exceeded, either the speed of the system can be reduced until the operational reliability state signal falls back below the limiting value whereupon the system can continue to be operated at the originally wanted speed, or the system can be immediately shut down automatically in order to prevent a cable coming off the monitored and defective cable pulley 22 for example.

It is not absolutely essential for the first parameter and the second parameter to be determined at the same pulley assembly 18. It is also possible to provide just one reference pulley 46 for the entire transportation system 10 and otherwise, monitor the other cable pulleys 22 and determine a parameter of the other cable pulleys 22 with the aid of the parameter measuring device 50. As already explained, a cable sheave 48 is particularly suitable as a reference component. Since, however, the cable 12 is not pulled continuously over a pulley assembly 18, but rather the amount by which it dips in the span 28 can alter in load-dependent manner, this will lead without doubt to a discontinuity in the speed of the cable at different pulley assemblies 18. If, for the purposes of monitoring a cable pulley 22, a reference pulley 46 in the same pulley assembly 18 is selected, then speed components produced as a result of variations in the load or varying accelerations of the cable will be compensated in the process of determining the parameter deviation.

As an alternative, encapsulated incremental or absolute position measuring systems could also be utilised as parameter measuring devices 50 in dependence on the type of parameter that is to be measured.

If the individual measured parameters are supplied to the evaluating device 70 in the control post 72, then transmission and measuring errors can be detected and plausibility checks made using a correlation of the individual measured values at each pulley assembly 18 or at various different pulley assemblies 18. This applies in analogously corresponding manner to all the moving components in the system. If excessive differences arise thereby, then this may be due to a breakdown of the entire wear monitoring system 38 or of parts thereof for example, and in particular, could also be the result of the derailment of a cable. In each case, safer operation of the transportation system 10 can be ensured due to these redundantly determined measured values.

Preferably, parameter measuring devices 50 of different type of construction and transmission mode are used in order not to generate systematic errors in the operation of the wear monitoring system 38.

The described wear monitoring system 38 has the great advantage that it is completely independent of the type and the construction of the system components of the transportation system 10 that are being used and monitored.

In particular, it does not depend on the cable lay or the type of construction of the cable 12.

What is claimed is:

1. A wear monitoring system for monitoring wear and abrasion of at least one system component of a cable operated transportation system, comprising:

at least one of a support cable, a traction cable, and a hoisting cable, at least one drive unit, a parameter measuring device for measuring at least one of: (a) an actual value of; and (b) a time-dependent actual value function of, at least one of an electrical parameter and a mechanical parameter of at least one of the at least one system component and the at least one drive unit, the at least one system component being subjected to wear and abrasion and being mounted in a rotating and/or a circulating manner, and an evaluating device for determining a parameter deviation of: (i) the actual value from a desired value in dependence on at least one of time or a time interval of, and (ii) the actual value function from a time-dependent desired value function of, the at least one electrical and mechanical parameter, the parameter deviation corresponding to at least one of a state of the abrasion and wear of the at least one system component, wherein the parameter measuring device comprises at least one of a torque measuring device, a rotational speed measuring device, an angular speed measuring device, a current measuring device, and a voltage measuring device for measuring the at least one mechanical and electrical parameter as at least one of torque, a rotational speed, an angular speed, a drive current of the at least one drive unit, and a drive voltage of the at least one drive unit.

2. A wear monitoring system in accordance with claim 1, wherein the evaluating device is configured to determine a change of the parameter deviation in dependence on a period of operation or an operating interval of the transportation system, the change of the parameter deviation corresponding to the state of abrasion and wear of the at least one system component in dependence on the period of operation or the operating interval.

3. A wear monitoring system in accordance with claim 1, further comprising a state of abrasion determining device for determining the state of the abrasion and wear of the at least one system component in dependence on at least one of the parameter deviation and a change of the parameter deviation.

4. A wear monitoring system in accordance with claim 1, further comprising an operational reliability state determining device for determining the operational reliability state of the transportation system in dependence on the state of abrasion and wear of the at least one system component.

5. A wear monitoring system in accordance with claim 1, wherein the parameter measuring device is configured so that the actual value of the at least one electrical and mechanical parameter can be determined in a time-dependent manner.

6. A wear monitoring system in accordance with claim 1, wherein a duration of the time interval is one of preset and variable.

7. A wear monitoring system in accordance with claim 1, further comprising:

at least one reference component, wherein the at least one reference component and the at least one system component are configured so that, in a starting state occurring when the system is started-up, a value of a first movement magnitude of the at least one system component is smaller than a value of at least one second movement magnitude of the at least one reference component.

8. A wear monitoring system in accordance with claim 7, wherein a radius of the at least one reference component is greater than a radius of the at least one system component.

9. A wear monitoring system for monitoring wear and abrasion of at least one system component of a cable operated transportation system, comprising:

at least one of a support cable, a traction cable, and a hoisting cable, at least one drive unit, a parameter measuring device for measuring at least one of: (a) an actual value of; and (b) a time-dependent actual value function of, at least one of an electrical parameter and a mechanical parameter of at least one of the at least one system component and the at least one drive unit, the at least one system component being subjected to wear and abrasion and being mounted in a rotating and/or a circulating manner, and an evaluating device for determining a parameter deviation of: (i) the actual value from a desired value in dependence on at least one of time or a time interval of, and (ii) the actual value function from a time-dependent desired value function of, the at least one electrical and mechanical parameter, the parameter deviation corresponding to a state of the abrasion and wear of the at least one system component, wherein the parameter measuring device comprises a clock pulse emitting member which is connectable in a mutually non-rotatable manner to the at least one system component for which a mechanical movement magnitude is to be determined, and at least one sensor for detecting a rotation of the clock pulse emitting member.

10. A cable operated transportation system, comprising:

a cable, at least one drive unit for moving the cable at least one system component which is subjected to wear and abrasion and is mounted in at least one of a rotating and a circulating manner for at least one of driving and guiding the cable or other components of the transportation system, a wear monitoring system for monitoring the wear and abrasion of the at least one system component, the wear monitoring system comprises a parameter measuring device for measuring at least one of: (a) an actual value of; and (b) a time-dependent actual value function of, at least one of at least one electrical and mechanical parameter of at least one of the at least one system component and the at least one drive unit, and an evaluating device for determining a parameter deviation of: (i) the actual value from a desired value in dependence on at least one of time or a time interval of; and (ii) the actual value function from a time-dependent desired value function of, the at least one electrical and mechanical parameter, the parameter deviation corresponding to a state of the abrasion and wear of the at least one system component;

wherein the parameter measuring device comprises at least one of a torque measuring device, a rotational speed measuring device, an angular speed measuring device, a current measuring device, and a voltage measuring device for measuring the at least one mechanical and electrical parameter as at least one of a torque, a rotational speed, an angular speed, a drive current of the at least one drive unit, and a drive voltage of the at least one drive unit.

11. A cable operated transportation system in accordance with claim 10, wherein the evaluating device is configured to determine a change of the parameter deviation in dependence on a period of operation or an operating interval of the transportation system, the change of the parameter deviation corresponding to the state the abrasion and wear of the at least one system component in dependence on the period of operation or the operating interval.

12. A method for monitoring wear and abrasion of at least one system component which is subjected to wear and abrasion and is mounted in at least one of a rotating and a circulating manner and forms part of a cable operated transportation system comprising at least one of a support cable, a traction cable, and a hoisting cable, and at least one drive unit, the method comprising:

measuring at least one of: (a) an actual value of; and (b) a time-dependent actual value function of, at least one of at least one electrical and mechanical parameter of at least one of the at least one system component and the at least one drive unit, determining a parameter deviation of: (i) the actual value from a desired value in dependence on at least one of time or a time interval of, and (ii) the actual value function from a time-dependent desired value function of, the at least one electrical and mechanical parameter, the parameter deviation corresponding to at least one of a state of the abrasion and wear of the at least one system component, wherein the at least one electrical and mechanical parameter is measured as at least one of a torque, a rotational speed, an angular speed, a drive current of the at least one drive unit, and a drive voltage of the at least one drive unit.

13. A method in accordance with claim 12, further comprising:

determining a change of the parameter deviation in dependence on a period of operation or an operating interval of the transportation system, the change of the parameter deviation corresponding to the state the abrasion and wear of the at least one system component in dependence on the period of operation or the operating interval.

14. A method in accordance with claim 12, wherein the at least one electrical and mechanical parameter is measured at least one of a cable pulley, a cable sheave, a deflection sheave, a drive sheave, a friction wheel or a drive belt.

15. A method in accordance with claim 13, wherein the state of the abrasion and wear of the at least one system component is determined in dependence on at least one of the parameter deviation and the change of the parameter deviation.

16. A method in accordance with claim 12, an operational reliability state of the transportation system is determined in dependence on the state of abrasion and wear of the at least one system component.

17. A method in accordance with claim 12, wherein two or more electrical and/or mechanical parameters are determined at the same time.

18. A method in accordance with claim 12, wherein the actual value of the at least one electrical and mechanical parameter is measured in a time-dependent manner.

19. A method in accordance with claim 12, wherein a duration of the time interval is one of preset and variable.

20. A method for monitoring wear and abrasion of at least one system component which is subjected to wear and abrasion and is mounted in at least one of a rotating and a circulating manner and forms part of a cable operated transportation system comprising at least one of a support cable, a traction cable, and a hoisting cable, and at least one drive unit, the method comprising:

measuring at least one of: (a) an actual value of; and (b) a time-dependent actual value function of, at least one of at least one electrical and mechanical parameter of at least one of the at least one system component and the at least one drive unit, determining a parameter deviation of: (i) the actual value from a desired value in dependence on at least one of time or a time interval of, and (ii) the actual value function from a time-dependent desired value function of, the at least one electrical and mechanical parameter, the parameter deviation corresponding to a state of the abrasion and wear of the at least one system component, wherein an operational reliability state of the transportation system is determined in dependence on the state of abrasion and wear of the at least one system component; and an operational reliability state signal is produced, said signal corresponding to a value of the operational reliability state on a comparison scale which is associated with the state of abrasion and wear of the at least one system component.

21. A method in accordance with claim 20, wherein an alarm and/or a shut down signal is produced if the value of the operational reliability state signal exceeds at least one limiting value.

* * * * *